US007460103B2

(12) United States Patent
Konno et al.

(10) Patent No.: US 7,460,103 B2
(45) Date of Patent: Dec. 2, 2008

(54) LIQUID CRYSTAL DISPLAY APPARATUS WITH LUMINANCE DISTRIBUTION CALCULATING, BACKLIGHT CONTROLLER, AND VIDEO CORRECTION TO IMPROVE DISPLAY CONTRAST RATIO

(75) Inventors: Akitoyo Konno, Hitachi (JP); Masaya Adachi, Hitachi (JP); Daisuke Kajita, Hitachi (JP); Tsunenori Yamamoto, Hitachi (JP); Katsumi Kondo, Mito (JP); Tatsuki Inuzuka, Mito (JP); Ikuo Hiyama, Hitachinaka (JP); Yuka Utsumi, Hitachi (JP)

(73) Assignee: Hitachi Displays, Ltd., Mobara-shi (JP)

( * ) Notice: Subject to any disclaimer, the term of this patent is extended or adjusted under 35 U.S.C. 154(b) by 718 days.

(21) Appl. No.: 11/053,029

(22) Filed: Feb. 9, 2005

(65) Prior Publication Data

US 2005/0184952 A1 Aug. 25, 2005

(30) Foreign Application Priority Data

Feb. 9, 2004 (JP) ..... 2004-031883
Dec. 20, 2004 (JP) ..... 2004-366988

(51) Int. Cl.
*G09G 3/36* (2006.01)

(52) U.S. Cl. ..... 345/102; 349/69

(58) Field of Classification Search ..... 345/38, 345/47, 48, 63, 77, 87, 90, 102, 104, 206, 345/207, 211, 690; 349/69
See application file for complete search history.

(56) References Cited

U.S. PATENT DOCUMENTS 5,668,569 A * 9/1997 Greene et al. ..... 345/103

(Continued)

FOREIGN PATENT DOCUMENTS

| | | |
|---|---|---|
| JP | 06-214508 | 8/1994 |
| JP | 2001-142409 | 5/2001 |
| JP | 2001-290125 | 10/2001 |
| JP | 2002-041007 | 2/2002 |
| JP | 2002-202767 | 7/2002 |

OTHER PUBLICATIONS

Light Output Feedback Solution for RGB LED Backlight Application SID 03 Digest, p. 1254-1257.

Reduction of LCTV Backlight Power and Enhancement of Gray Scale Capability by Using and Adapative Dimming Technique.

*Primary Examiner*—Amare Mengistu
*Assistant Examiner*—Vinh T Lam
(74) *Attorney, Agent, or Firm*—Antonelli, Terry, Stout & Kraus, LLP.

(57) ABSTRACT

The video display apparatus has a light modulation device for forming a picture in accordance with a video signal and a lighting unit for irradiating, on the light modulation device, illumination light necessary to cause it to display the picture. In the apparatus, the lighting unit irradiates the illumination light in sequence of individual plural illumination light source partitive areas, a luminance distribution calculating unit calculates luminance distributions of video signals corresponding to the plural partitive areas to determine illumination light luminance levels of the individual partitive areas, an illumination controller controls rays of the illumination light of individual areas of the lighting unit on the basis of determination by the luminance distribution calculating unit, and a video corrector corrects the video signal inputted to the light modulation device on the basis of the determination by the luminance distribution calculating unit.

9 Claims, 40 Drawing Sheets

U.S. PATENT DOCUMENTS 5,719,643 A * 2/1998 Nakajima ..... 348/700
5,818,553 A * 10/1998 Koenck et al. ..... 349/61
6,297,797 B1 * 10/2001 Takeuchi et al. ..... 345/467
6,888,529 B2 * 5/2005 Bruning et al. ..... 345/102
6,891,524 B2 * 5/2005 Sakashita ..... 345/89
7,027,016 B2 * 4/2006 Sakashita ..... 345/84
2001/0033260 A1 * 10/2001 Nishitani et al. ..... 345/87
2002/0050987 A1 * 5/2002 Sakashita ..... 345/204
2002/0061178 A1 * 5/2002 Winston et al. ..... 385/133
2005/0156867 A1 * 7/2005 Edelbrock ..... 345/102
2007/0120765 A1 * 5/2007 Misonou et al. ..... 345/38

* cited by examiner

FIG. 5A
FIG. 5B
FIG. 5C
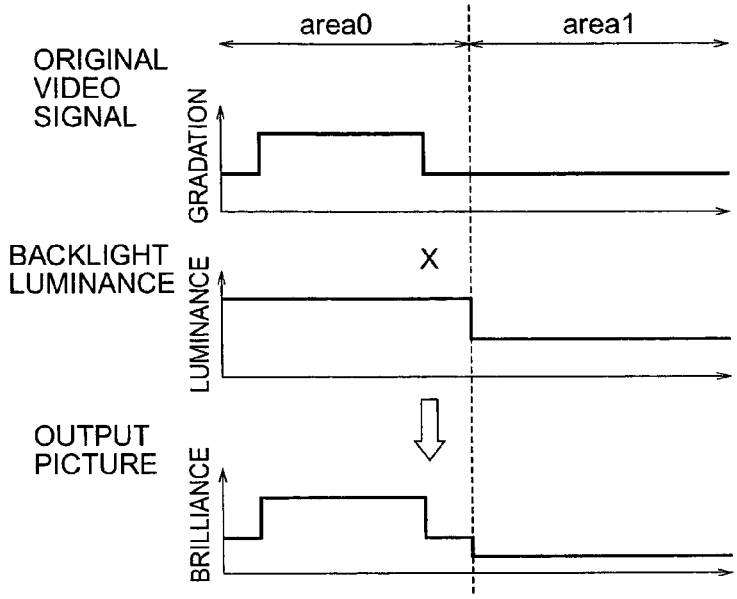
FIG. 6A
FIG. 6B
FIG. 6C
FIG. 6D
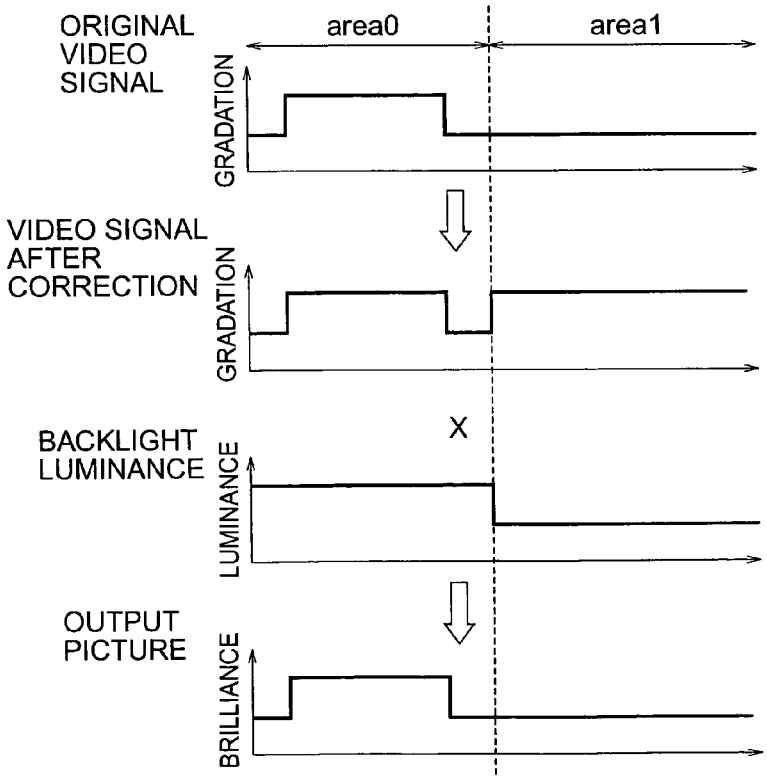

FIG. 7
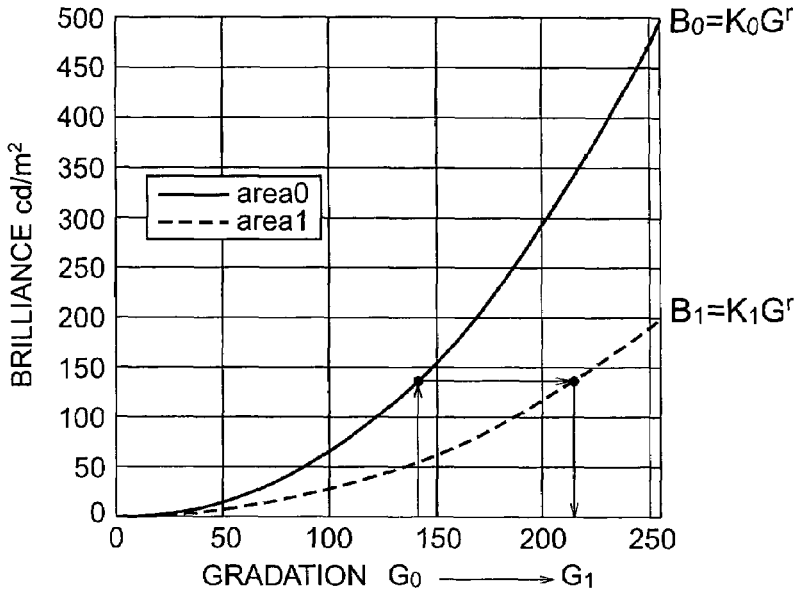
FIG. 8A
FIG. 8B
FIG. 8C
FIG. 8D
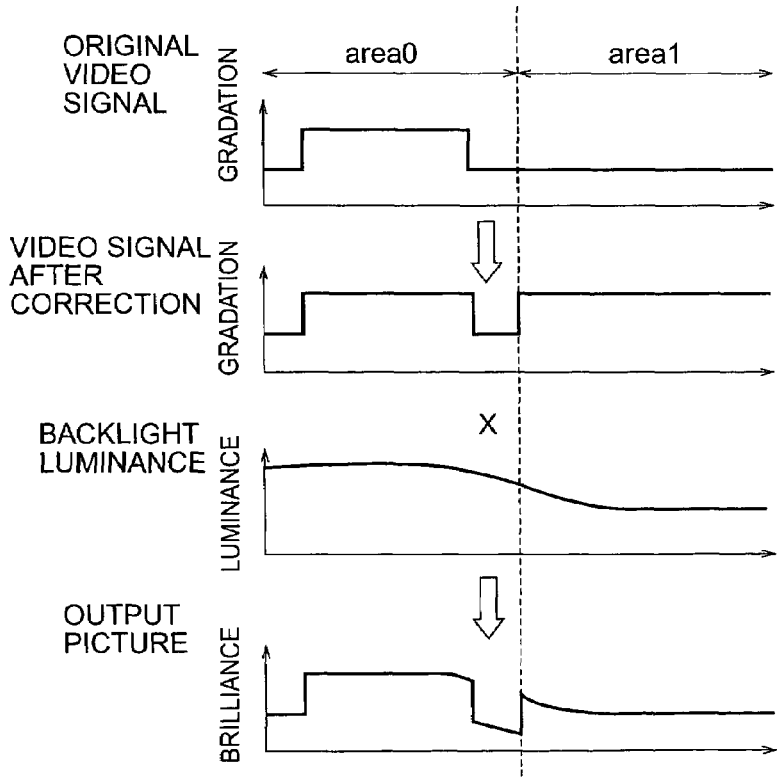

FIG. 9A
FIG. 9B
FIG. 9C
FIG. 9D
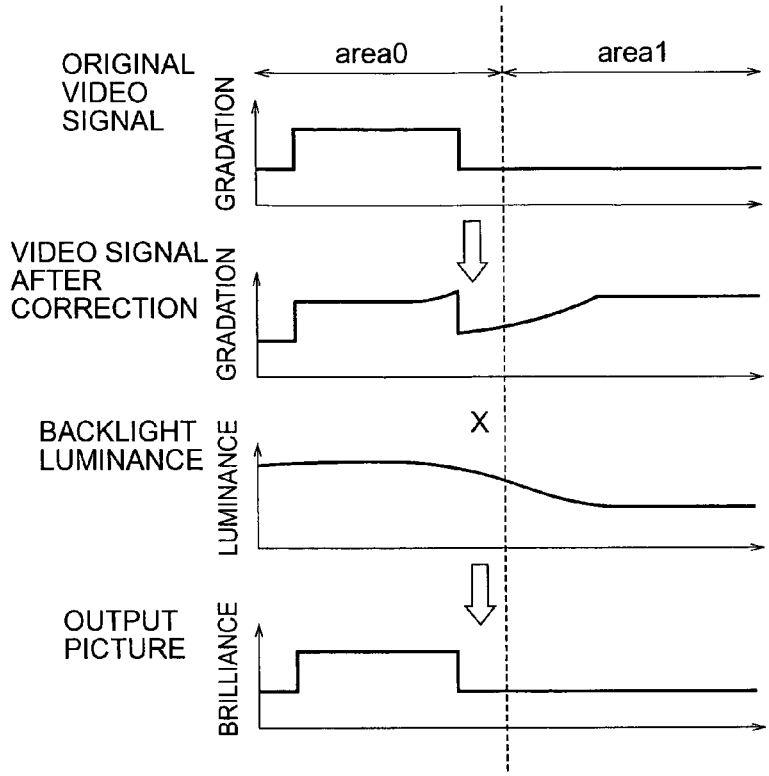
FIG. 10
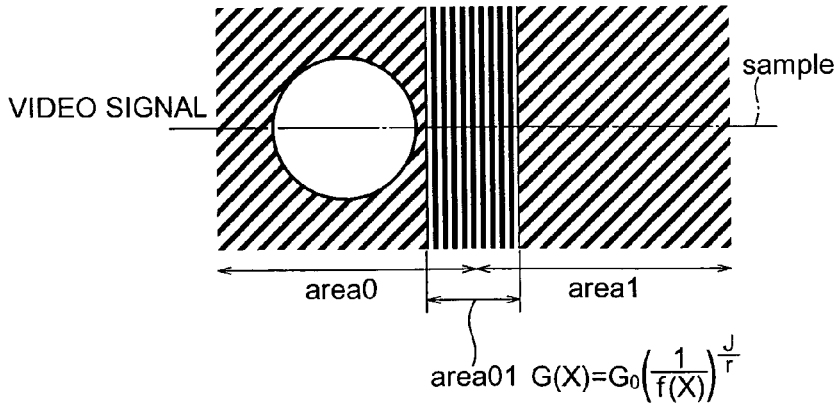

(FRONT VIEW OF LIQUID CRYSTAL DISPLAY APPARATUS)

(LIQUID CRYSTAL DISPLAY APPARATUS SECTIONAL VIEW)

LIQUID CRYSTAL DISPLAY APPARATUS WITH LUMINANCE DISTRIBUTION CALCULATING, BACKLIGHT CONTROLLER, AND VIDEO CORRECTION TO IMPROVE DISPLAY CONTRAST RATIO

BACKGROUND OF THE INVENTION

The present invention relates to a video display apparatus for displaying a picture by modulating illumination light in accordance with a video signal and more particularly to, a lighting unit for controlling the luminance of illumination light in accordance with video signals, a video display apparatus provided with the lighting unit and a video display method using the same.

The display apparatus can be classified principally into a luminous display apparatus such as CRT (cathode ray tube) or plasma display panel and a non-luminous display apparatus such as liquid crystal display (also called a liquid crystal display apparatus or liquid crystal display panel) or electrochromic display.

Available as the non-luminous display apparatus are an apparatus of the type using a reflection type light modulation device adapted to adjust the quantity of reflection light in accordance with a video signal and an apparatus of the type using a transmission type light modulation device adapted to adjust the quantity of transmission light in accordance with a video signal. Especially, a liquid crystal display apparatus using a liquid crystal display device (also called a liquid crystal display panel) as transmission type light modulation device and having a lighting unit (also called a backlight) on the back of the device is thin and light in weight and is therefore employed for various kinds of display apparatus including a monitor of computer and a television (TV).

Incidentally, when displaying a picture in the self-luminous display apparatus such as CRT, a specified pixel is selectively lit by a necessary quantity of light in accordance with a video signal. Accordingly, for a black display or a dark picture display, lighting of the pixel can be stopped or the lighting quantity can be decreased to reduce power consumption. Further, in the case of the black display, the pixel is not lit and the contrast ratio can be increased up to several of tens of thousands or more in a dark room.

On the contrary, generally in the non-luminous type display apparatus such as liquid crystal display apparatus, a backlight is, in general, lit constantly at a constant luminance level regardless of a video signal. Accordingly, the luminance of backlight normally matches with a condition for making the screen have maximum luminance and the backlight is lit at the same luminance even when a dark display is exhibited or a dark picture is displayed, with the result that unnecessary power not contributing to display is consumed. Further, in the case of the black display, part of light of the backlight leaks, leading to insufficient darkness and the contrast ratio in a dark room is about 500 to 1000 which is smaller than that of the self-luminous display apparatus such as CRT.

A liquid crystal display apparatus has hitherto been proposed which reduces power consumption and improves picture quality by controlling the ambient light (hereinafter specifically termed luminance) of the backlight.

For example, JP-A-2001-142409 discloses that a backlight panel is driven in units of plural partitive areas and the luminance of the backlight is controlled in accordance with video signals to thereby reduce power consumption.

Further, JP-A-2001-290125 discloses a technique according to which an electroluminescence (EL) panel having EL elements of three colors of red, green and blue is disposed on the back of a liquid crystal display panel and luminescence of the EL elements is controlled in accordance with video signals to thereby prevent such a degradation in picture quality as a blur or ooze of color during motion picture.

Furthermore, JP-A-2002-202767 discloses that when a picture has high luminance locally or the overall screen is required to exhibit high luminance in relation to a criterion of one picture frame, the luminance of backlight is raised but in the other case, the luminance of backlight is kept at a normal level, thereby realizing a high contrast ratio.

SUMMARY OF THE INVENTION

In the non-luminous type display apparatus such as liquid crystal display apparatus described in the background arts, a sufficient contrast ratio, in other words, a wide display luminance range cannot be obtained. For this reason, by controlling the luminance of backlight in accordance with video signals, the display luminance range can be widened and the contrast ratio can be improved.

The aforementioned background arts disclose techniques of controlling the luminance of backlight for the sake of various purposes but any of them have difficulties with maintaining picture quality.

For example, in the case of the method of controlling the luminance of the overall screen by adjusting the luminance of backlight, when a locally bright area exists in a picture and the luminance of the backlight is raised, the luminance of a dark area coexistent in the picture rises and a desired low level of luminance cannot be realized, giving rise to a problem that the picture quality is degraded. In other words, the method of controlling the luminance of the overall screen by adjusting the luminance of backlight fails to improve the contrast ratio in essentiality and disadvantageously, a high contrast ratio cannot be obtained.

Further, when the backlight is driven in units of plural partitive areas (also called partitive backlight areas) and the luminance of backlight is controlled in accordance with a video signal, an undesirable luminance difference is caused in a display picture at a position corresponding to the boundary between adjacent partitive backlight areas. Reasons for this are as follows.

For example, to explain with reference to FIG. 4, it is now supposed that in two adjacent screen areas (designated by area0 and area1 in the figure), a video signal to be displayed exhibits a high luminance level only in the center of one screen area (area0) and exhibits the same luminance level at the remaining part of the one area as that at the other screen area (area1).

In this case, the luminance of a partitive backlight areas corresponding to the screen area0 is raised in accordance with the video signal. As a result, the luminance differs for the partitive backlight areas corresponding to the screen areas area0 and area1, respectively.

Then, the luminance of a picture delivered out of the liquid crystal display apparatus equals the product of the luminance of backlight and the transmission factor of liquid crystal panel which is controlled in accordance with the video signal. Accordingly, in case there is a difference in backlight luminance between the adjacent partitive backlight areas, an unwanted luminance difference takes place in the delivered picture at a boundary area portion where no difference in luminance exists originally, thus facing a problem that the picture quality is degraded.

The present invention has been made to eliminate the above problems and it is an object of this invention to realize a lighting unit capable of preventing the degradation in picture quality and reducing the power consumption and to realize video display apparatus and method capable of widening the display luminance range and raising the contrast ratio without degrading the picture quality.

Constituents characteristic of this invention will now be described by making reference to reference numerals in the accompanying drawings. Firstly, according to this invention, a lighting unit for irradiating, on a light modulation device (10) adapted to form a picture in accordance with a video signal, illumination light necessary to cause it to display the picture, comprises illumination means (20) for emitting the illumination light in sequence of individual plural partitive areas (25) of the illumination means, luminance distribution calculating means (50) for determining luminance levels of illumination light of the individual areas on the basis of video signals corresponding to the plurality of areas, and backlight control means (80) for controlling the illumination light of the individual areas of the illumination means on the basis of determination by the luminance distribution calculating means, whereby consumptive power of the lighting unit can be reduced.

Next, according to this invention, a video display apparatus having a light modulation device (10) for forming a picture in accordance with a video signal and a lighting unit for irradiating, on the light modulation device, illumination light necessary to cause it to display the picture, comprises illumination means (20) for emitting the illumination light in sequence of individual plural partitive areas (25) of the illumination means, luminance distribution calculating means (50) for calculating luminance distributions of video signals corresponding to the plurality of areas and determining luminance levels of illumination light of the individual areas, illumination control means (80) for controlling the illumination light of the individual areas of the illumination means on the basis of determination by the luminance distribution calculating means, and video correction means (60) for correcting the video signal inputted to the light modulation device on the basis of the determination by the luminance distribution calculating means, whereby a picture of high contrast ratio and high quality can be obtained and consumptive power of the lighting unit can be reduced.

The luminance distribution calculating means (50) determines illumination luminance levels of the individual areas and the video correction means (60) corrects the video signal inputted to the light modulation device (10) on the basis of the determination by respecting the illumination luminance levels of the individual areas and an illumination luminance distribution between areas, whereby a picture of high contrast ratio and of less irregularities can be obtained and consumptive power of the lighting unit can be reduced.

Further, according to this invention, a video display method of causing a light modulation device irradiated with illumination light from a lighting unit to display a picture in accordance with a video signal, the lighting unit being operative to emit the illumination light in sequence of individual plural partitive areas, comprises determining (90*p*2), on the basis of video signals for the individual areas (90*p*1), luminance levels of rays of the illumination light of the individual areas which are emitted from the lighting unit, and controlling (90*p*5) the illumination light of the lighting unit and correcting (90*p*4) the video signals on the basis of the determination, whereby a picture of high contrast ratio and quality can be obtained and consumptive power of the lighting unit can be reduced.

Correction (90*p*4) of the video signal is carried out on the basis of an illumination luminance distribution between areas (90*p*3), whereby a picture of high contrast ratio and less irregularities can be obtained and consumptive power of the lighting unit can be reduced.

In determination (90*p*2) of rays of the illumination light of individual areas which are emitted from the lighting unit, the illumination light is determined by correcting (90*p*4) the video signal such that an area of good characteristic ((c) in FIG. 31) of the light modulation device can be used, whereby a picture of high contrast ratio and less irregularities can be obtained, consumptive power of the lighting unit can be reduced and view angle can be improved.

In the present invention, illumination light emission operation of the individual areas of the lighting unit is controlled and the video signal is corrected on the basis of video signals for the individual areas, thus having advantages that the high contrast ratio and picture quality of less irregularities can be obtained and power consumption of the lighting unit can be reduced. In addition, since improvements in picture quality and view angle of the video display apparatus can be accomplished, the present invention can be applicable to many types of video display apparatus such as advertisement display, TV display and personal computer display.

Other objects, features and advantages of the invention will become apparent from the following description of the embodiments of the invention taken in conjunction with the accompanying drawings.

BRIEF DESCRIPTION OF THE DRAWINGS

FIGS. 5A to 5C are diagrams for explaining picture quality degradation when the backlight luminance is controlled area by area without making video signal correction.

FIGS. 6A to 6D are diagrams showing reduction of picture quality degradation through video signal correction.

FIG. 7 is a graph showing the principle of gamma correction.

FIGS. 8A to 8D are diagrams for explaining picture quality degradation due to a backlight luminance distribution between areas.

FIGS. 9A to 9D are diagrams for explaining suppression of picture quality degradation by video signal correction which compensates for the inter-area backlight luminance distribution.

FIG. 10 is a diagram for explaining an area in which the backlight luminance distribution exists.

DESCRIPTION OF THE EMBODIMENTS

Embodiments of the present invention will now be described in greater detail with reference to the accompanying drawings.

Embodiment 1

FIG. 1 to FIGS. 11A and 11B are illustrative of embodiment 1 of the invention and firstly, raising the contrast ratio by widening the display luminance range will be described with reference to FIG. 1.

Figure 1:
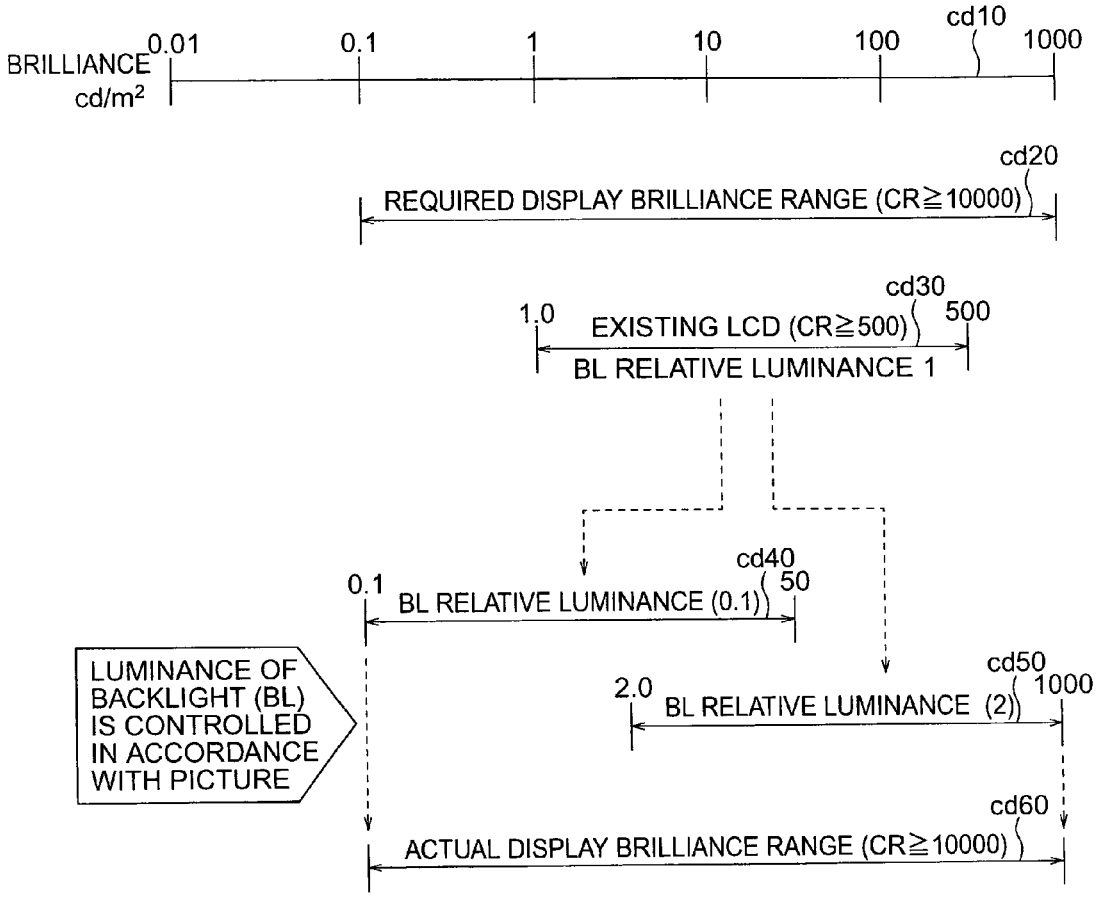
FIG. 1 is a diagram for explaining display brilliancy range enlargement by controlling the backlight luminance in respect of individual areas.

It is assumed that in FIG. 1, an existing liquid crystal display apparatus has a backlight (BL) which exhibits a relative luminance defined as 1. In case an ideal display luminance range (cd10) is 0.01 cd/m$^2$ to 1000 cd/m$^2$, a display luminance range (cd20) from 0.1 cd/m$^2$ to 1000 cd/m$^2$ and a contrast ratio (CR)≧10000 are required for the liquid crystal display apparatus.

But, the liquid crystal display apparatus exhibits at present a display luminance range (cd30) which is 1.0 cd/m$^2$ to 500 cd/m$^2$ and a small contrast ratio (CR) of 500. This is accounted for by the fact that in the liquid crystal display apparatus explained in the background arts, the backlight is lit constantly at constant luminance regardless of a video signal and as a result, part of light of the backlight leaks and sufficient darkness cannot be attained during black display.

To cope with this problem, in the present invention, the luminance of backlight is controlled in accordance with a video signal in such a manner that for example, when the video signal is dark, the luminance of backlight is so controlled as to be dark to provide a display luminance range (cd40) of 0.1 cd/m$^2$ to 50 cd/m$^2$ (BL relative luminance being 0.1). On the other hand, when the video signal is bright, the luminance of backlight is so controlled as to be bright to thereby provide a display luminance range (cd50) of 2.0 cd/m$^2$ to 1000 cd/m$^2$ (BL relative luminance being 2), so that a practical display luminance range (cd60) which coincides with the required display luminance range (cd20) can be obtained.

Figure 2:
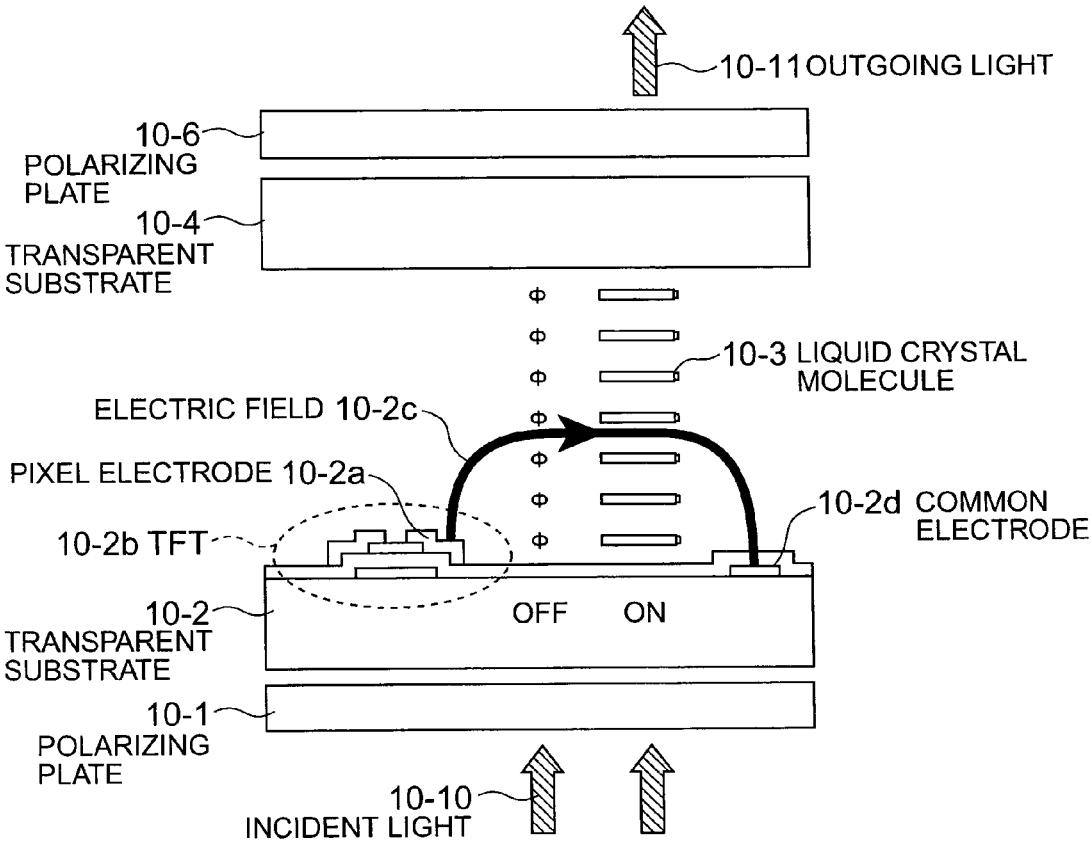
FIG. 2 is a diagram for explaining the lateral electric field switching scheme.

Turning now to FIG. 2, the principle of a liquid crystal display panel (hereinafter also called "LCD panel") of lateral electric field switching scheme representing a preferred embodiment of a light modulation device according to the invention is diagrammatically illustrated. The LCD panel has pixels each including a pixel electrode (10-2*a*), a common electrode (10-2*d*), these electrodes being arranged on a transparent substrate (10-2), and a switching element (10-2*b*) formed of a TFT (thin film transistor) connected to the pixel electrode (10-2*a*).

A liquid crystal layer formed of positive nematic liquid crystals having dielectric anisotropy is interposed between two transparent substrates (10-2) and (10-4) and liquid crystal molecules (10-3) constituting the liquid crystal layer have their orientation directions of liquid crystal molecular longitudinal axis regulated by orientation films, not shown, formed on the two transparent substrates (10-2) and (10-4). Ideally, the orientation direction of liquid crystal molecules (10-3) conforms to so-called homogenous orientation free from twist between the two transparent substrates (10-2) and (10-4).

Polarizing plates (10-6) and (10-1) are arranged in front of the transparent substrate (10-4) and on the back of the transparent substrate (10-2), respectively. The polarizing plates (10-1) and (10-6) are so arranged that their axes for transmission of linearly polarized light are orthogonal to each other. The polarizing plate (10-1) is arranged such that its transmission axis for linearly polarized light is parallel or orthogonal to the orientation direction of liquid crystal molecules (10-3).

Light emitted from a backlight and incident on the LCD panel (incident light (10-10) transmits through the polarizing plate (10-1) and passes through the liquid crystal layer so as to be incident on the polarizing plate (10-6). In this phase, when a voltage for changing the arrangement of liquid crystal molecules (10-3) is not applied (OFF) between pixel electrode (10-2*a*) and common electrode (10-2*d*), most of the light rays incident on the polarization plate (10-6) are absorbed to provide a black (dark) display.

On the other hand, with a voltage applied (ON) between pixel electrode (10-2*a*) and common electrode (10-2*d*) to cause the arrangement of liquid crystal molecules (10-3) to change owing to an electric field (10-2*c*) mainly generated in the lateral direction, the light incident on the polarizing plate (10-6) changes in its polarized state and is allowed to transmit through the polarizing plate (10-6) to provide output or outgoing light (10-11), thus realizing a display of predetermined luminance or ambient light.

The LCD panel of lateral electric field switching scheme has a wide view field angle and is therefore widely used for a monitor of personal computer (PC) and television (TV).

In addition to the LCD panel of lateral electric field switching scheme, an LCD panel of, for example, TN (twisted nematic) scheme, STN (super twisted nematic) scheme, ECB (electrical controlled birefringence) scheme or VA (vertical alignment) scheme may be used for the light modulation device. The above LCD panel based on the above schemes is provided with a polarizing plate to display a picture by controlling the polarized state of light incident on the liquid crystal layer and can obtain a picture of high contrast ratio at a relatively low drive voltage, thereby finding the preferable use as the light modulation device of this invention.

Figure 3:
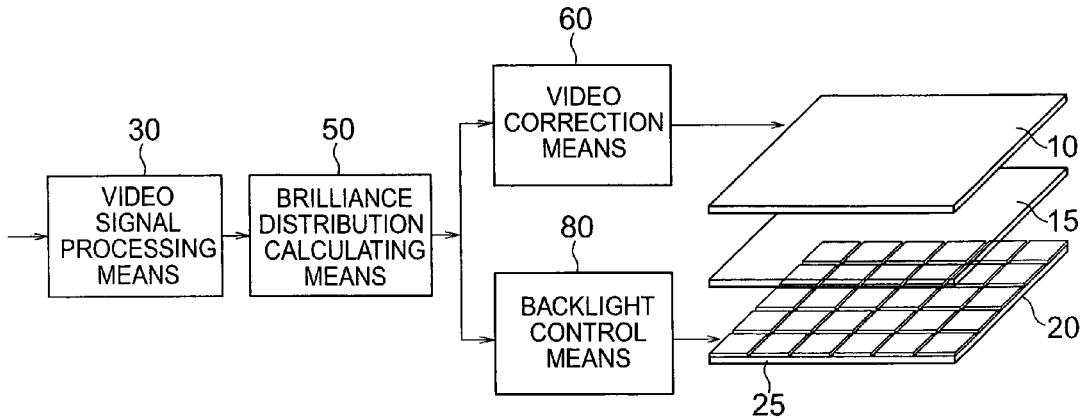
FIG. 3 is a schematic construction diagram of the whole of a video display apparatus according to this invention.

Referring now to FIG. 3, the overall construction of a video display apparatus according to the invention is schematically illustrated. The video display apparatus comprises a light modulation device 10 formed of an LCD panel, a light diffusing sheet 15, an LED panel 20 representing an illumination means for emitting illumination light, a video signal processing means 30, a luminance distribution calculating means 50, a video correction means 60 and a backlight control means 80 representing an illumination control means. The LED panel 20 is exemplified as being divided into partitions (5×6) to provide a plurality of partitive areas 25.

Firstly, when a video signal is inputted to the video signal processing means 30, a process of generating timing signals for video display and area control is carried out.

Next, in the luminance distribution calculating means 50, the maximum value/minimum value of the inputted original video signal is analyzed in correspondence with each area 25 and a backlight luminance level of each area 25 is determined in accordance with a result of analysis.

Next, the video correction means 60 performs a video correction in accordance with the backlight luminance level of each area 25. Concurrently therewith, the backlight control means 80 controls the backlight in accordance with the backlight luminance levels of the individual areas 25. Through this, as has been explained in connection with FIG. 1, the display luminance range required of the liquid crystal display apparatus can be covered and degradation of picture quality due to a difference in luminance between areas 25 can be prevented.

Figure 4:
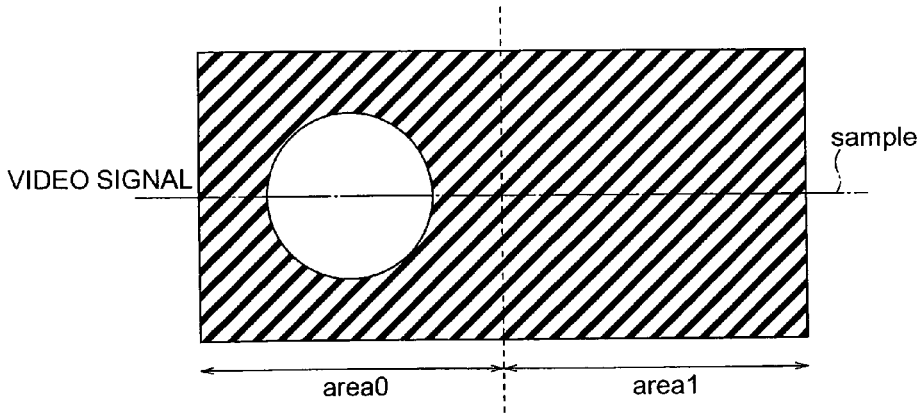
FIG. 4 is a diagram showing an example of a picture useful to explain advantages of this invention.

The principle of operation of this invention will be described with reference to FIG. 4 through FIGS. 11A and 11B. Illustrated in FIG. 4 is an example of a picture to be displayed in correspondence with two adjacent areas (area0 and area 1) in the video display apparatus. The figure shows an instance where a bright circle is displayed in the center of one area (area0) and where a portion exclusive of the circle (hereinafter referred to as a background) and the entirety of the other area (area1) are displayed in a darker tone than the circle. Here, a display operation along a position indicated by dotted line (sample) in FIG. 4 will be described.

In FIG. 4, the picture contains the bright portion in the one area (area0) but does not contain any bright portion in the other area (area1). Accordingly, the luminance of backlight is so controlled as to be high in the area (area0) and low in the area (area1). Through this control, the display luminance range can be widened and the contrast ratio can be raised as explained with reference to FIG. 1. But when this control is executed, a new problem that the picture quality is degraded arises. This will be explained with reference to FIGS. 5A to 5C.

In FIG. 5A, the original video signal diagrammatically indicates a gradation level to be displayed along the position indicated by dotted line (sample) in FIG. 4. In FIG. 5B, the backlight luminance diagrammatically indicates luminance levels of backlight controlled in respect of the individual areas. It will be appreciated that the transmission factor of the light modulation device (LCD panel) can be controlled in accordance with a video signal inputted thereto and therefore the gradation level of video signal can substitutionally be read as transmission factor level of the LCD panel. Accordingly, as shown at output picture in FIG. 5C, the luminance of an output picture is given by the product of the transmission factor of LCD panel controlled in accordance with the original video signal in FIG. 5A and the backlight luminance in FIG. 5B. In this case, since the luminance of backlight is high in the area (area0), the luminance of its background, which must originally be equal to that of the area (area1), becomes higher than the luminance of the area (area1).

In other words, when the luminance of backlight is controlled area by area, a difference in luminance takes place, that is, a difference in ambient light is caused at a portion which must originally be uniform in ambient light, thus degrading the picture quality.

Then, a method of correcting the video signal in order to prevent the occurrence of a degraded picture quality as above will be described with reference to FIGS. 6A to 6C. These figures are useful in explaining the principle of preventing the picture quality degradation from occurring by correcting an original video signal shown in FIG. 6A to a video signal as shown in FIG. 6B. Namely, in order to prevent the occurrence of a degraded picture even when the luminance of backlight is controlled as shown in FIG. 6C, a video signal for the area (area1) is so corrected as to have a level raised from the original video signal as shown in FIG. 6B. Through this, an output picture can be obtained which as shown in FIG. 6D corresponds to the original video signal, that is, a picture conforming to the gradation level of the picture to be displayed and removed of the picture quality degradation can be obtained.

The principle of correction of the video signal will be described by making reference to a graphical representation of FIG. 7 where abscissa represents gradation (gray scale) and ordinate represents luminance (unit:cd/$m^2$). For different levels of luminance of backlight, curves $B_0$ and $B_1$ indicate, respectively, the relation between gradation level and luminance of the video display apparatus, with the curve $B_0$ corresponding to area (area0) and the curve $B_1$ corresponding to area (area1). Here, the respective curves are generally called gamma curve and where G represents the gradation and B represents the luminance, the two are related to each other by the following equation (1):

$$B=kG^{\gamma} \tag{1}$$

In the equation (1), k is constant and $\gamma$ is generally termed the gamma coefficient having a value of about 1.8 to 3 in the ordinary video display apparatus.

Since the backlight luminance differs for the area (area0) and area (area1), the proportional constant k in equation (1) differs as shown in FIG. 7. The proportional constant k is in proportion to the luminance of backlight and when k is $k_0$ for area (area0) and $k_1$ for area (area1), $k_0>k_1$ stands in this example.

For example, when the gradation level of background of the area (area0) is $G_0$, with a view to making a luminance level corresponding to gradation $G_0$ in the area (area0) equal to a luminance level for the area (area1), the gradation level in the area (area1) can be obtained by converting gradation $G_0$ to gradation $G_1$ as shown in FIG. 7. This conversion can be expressed by equations (2) and (3) as below.

$$k_1G_1^{\gamma}=k_0G_0^{\gamma} \tag{2}$$

$$G_1=G_0(k_0/k_1)^{1/\gamma} \tag{3}$$

where $k_0/k_1$ represents the ratio of backlight luminance between area (area0) and area (area1).

By correcting (raising) the gradation level for the area (area1) of the original video signal shown in FIG. 6A to provide a video signal after correction as shown in FIG. 6B, the difference in luminance between the areas can be eliminated in an output picture as shown in FIG. 6D.

Actually, however, the backlight luminance does not change abruptly (stepwise) as shown in FIG. 6C between the areas but generally, it changes gradually as shown in FIG. 8C. Consequently, through the correction of video signal not respecting such a change in backlight luminance between the areas, the output picture is formed as exemplified in FIG. 8D, causing a degradation in picture quality. Accordingly, a video signal correction method respecting an inter-area luminance distribution of backlight will be described with reference to FIGS. 9A to 9D.

Referring to 9A to 9D, the principle of preventing the occurrence of picture quality degradation by correcting an original video signal shown in FIG. 9A to a video signal after correction shown in FIG. 9B will be explained. More specifically, the video signal is corrected in order that an inter-area luminance distribution as shown in FIG. 9C caused by the backlight luminance control effected in respect of the individual areas can be compensated for and consequently, a video signal after correction as shown in FIG. 9B can be obtained. Through this, an output picture can be a picture as shown in FIG. 9D which corresponds to the original video signal, that is, a picture conforming to the gradation level of the picture to be displayed and removed of the picture quality degradation can be obtained.

Figure 11A:
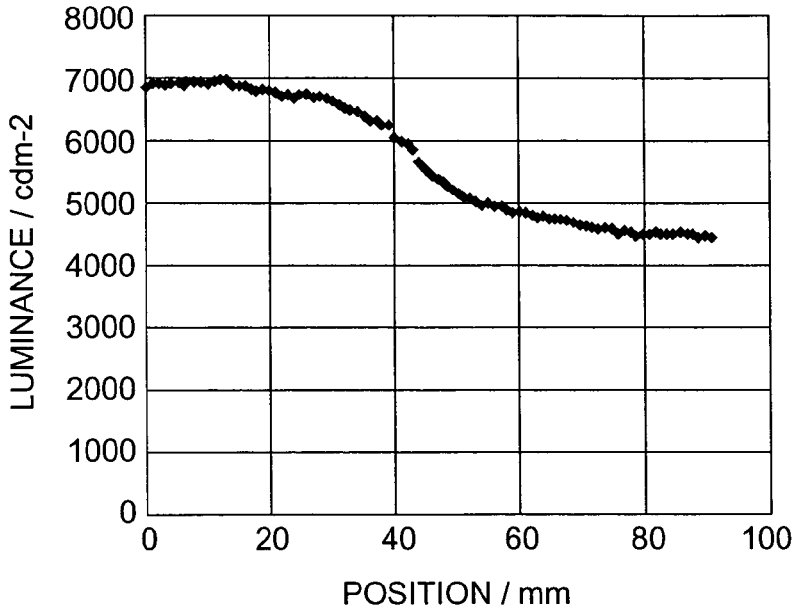
FIGS. 11A and 11B are graphs showing an actual measurement result of the inter-area backlight luminance distribution and its approximate function, respectively.
Figure 11B:
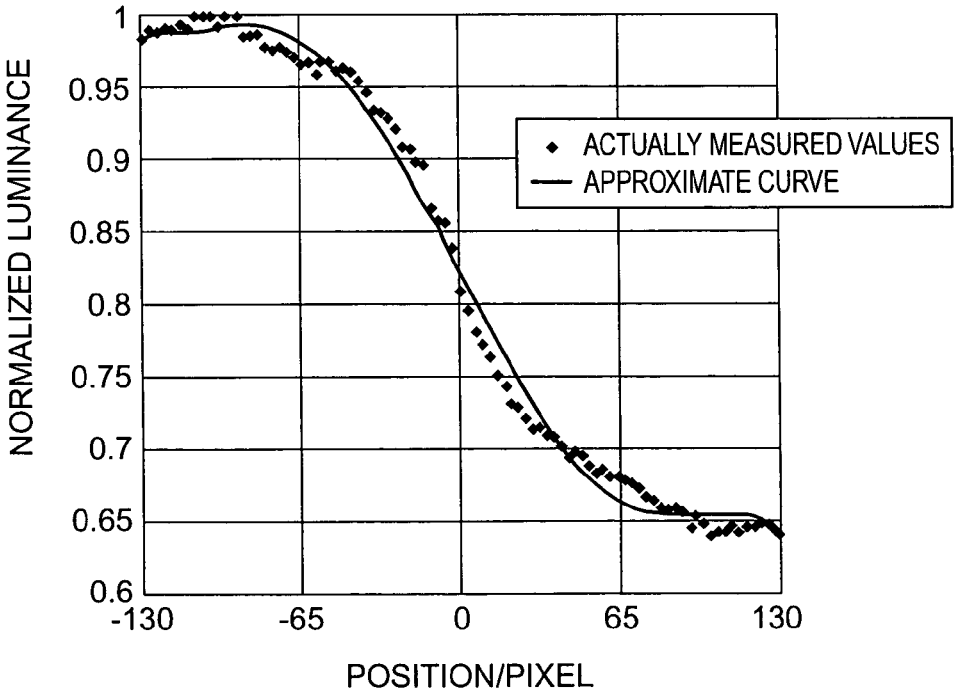

Turning now to FIG. 10 and FIGS. 11A and 11B, the video signal correction for compensating for the luminance distribution between the areas of backlight will be described. Illustrated in FIG. 11A is a result of actual measurement of the luminance distribution between the areas of backlight. In the figure, the ordinate is normalized so that a maximum luminance level of backlight (in this example, about 7000 cd/$m^2$) may assume 1, thereby obtaining a graphical representation of FIG. 11B where ordinate represents normalized luminance and abscissa represents the number of pixels. For simplicity of explanation, the boundary between the areas (area0) and (area1) is set to position 0 in FIG. 11B. Where abscissa is represented by X and ordinate is represented by f(X), the curve in FIG. 11B is approximated by an approximate function f(X). By using this approximate function, the video signal correction can be facilitated.

As will be seen from FIG. 11B, the influence of the luminance distribution takes place in a range of $-65<X<65$. This range is defined as an area (area01) and the video signal correction carried out using the approximate function f(X) will be described with reference to FIG. 10. Here, $G_0$ represents a gradation level of the original video signal, that is, of a picture to be displayed in the area (area01). In the example shown in FIG. 10, there is no difference in original video signal level in the area (area01) and hence $G_0$ is constant not depending on X but in general, $G_0$ is a function of X. In such a case, $G_0(X)$ may be introduced. Here, a video signal after correction (a gradation level ultimately inputted to each pixel) is defined as G(X), which G(X) can be expressed by the following equation (4):

$$G(X)=G_0[1/f(X)]^{1/\gamma} \tag{4}$$

In this example, the approximate function f(X) is first determined and then G(X) is determined pursuant to the equation shown in FIG. 10, that is, equation (4) but alternatively, the actually measured values of inter-area luminance distribution of backlight as exemplified in FIG. 11A may be stored in a memory and correction may be made on the basis of the stored values. Or, in another alternative, in the equation shown in FIG. 10, the coefficient part $G_0$ may be defined by an approximate function.

Embodiment 2

Embodiment 2 of this invention will be described hereunder with reference to FIG. 12 through FIGS. 17A to 17D. In the present embodiment, the overall schematic construction shown in FIG. 3 according to this invention will be detailed and like parts will be designated by like reference numerals.

Figure 12:
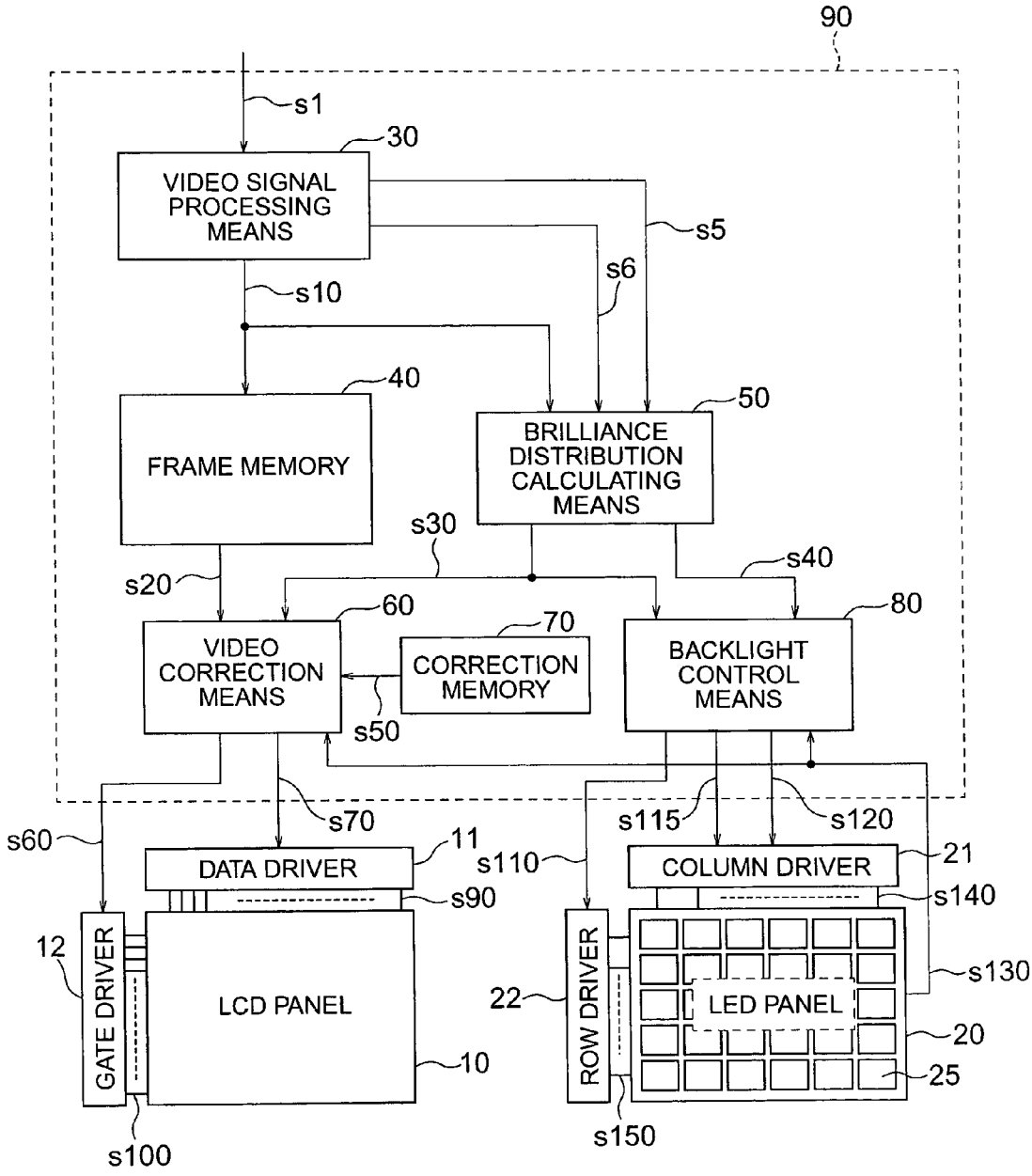
FIG. 12 is a block diagram showing a detailed construction of the whole of a video display apparatus according to the present invention.

In FIG. 12, an LCD panel is driven by signal lines s90 of data driver 11 and signal lines s100 of gate driver 12. A data signal s70 to the data driver 11 is fed from a video correction means 60. Further, a timing signal s60 to the gate driver 12 is also fed from the video correction means 60.

An LED panel 20 functioning as a backlight is driven by signal lines s140 of column driver 21 and signal lines s150 of row driver 22. A column driver signal s115 and a PWM signal s120 are supplied to the column driver 21 from a backlight control means 80. A timing signal s110 to the row driver 22 is also fed from the backlight control means 80. A sensor is arranged at a predetermined location of LED panel 20 and a sensor signal s130 is supplied to the backlight control means 80 and video correction means 60.

A display controller 90 for controlling the LCD panel 10 and LED panel 20 includes a video signal processing means 30 for generating various addresses s5 and s6 from a video signal s1, a frame memory 40 for storing a pixel signal s10 from the video signal processing means 30, a luminance distribution calculating means 50 for receiving the various signals s5 and s6 and the pixel signal s10 to calculate backlight luminance distributions of individual areas, the video correction means 60 responsive to a backlight luminance distribution data signal s30 from the luminance distribution calculating means 50 to correct display data s20, and the backlight control means 80 for receiving the backlight luminance distribution data signal s30 and an area identifying signal s40 from the luminance distribution calculating means 50 to control the luminance level of backlight.

Delivered out of the video signal processing means 30 are the input pixel address s5 indicative of an address of a picture written to the frame memory 40 and the display address s6 for display on the LCD panel. These addresses are supplied to the luminance distribution calculating means 50. Also delivered out of the video signal processing means 30 is the pixel signal s10 which in turn is supplied to the frame memory 40 and luminance distribution calculating means 50.

The display data s20 from the frame memory 40 is supplied to the video correction means 60. Delivered out of the luminance distribution calculating means 50 are the backlight luminance distribution data signals s30 and area identifying signals s40 for the respective areas. The backlight luminance distribution data signal s30 is inputted to the video correction means 60 and backlight control means 80 and the area identifying signal s40 is inputted to the backlight control means 80. In an alternative, a real time process may be carried out without resort to the frame memory 40.

The video correction means 60 is connected with a correction memory 70, in which the predetermined function f(X) shown in FIGS. 10 and 11B is tabulated, to read luminance gradient data s50.

Figure 13:
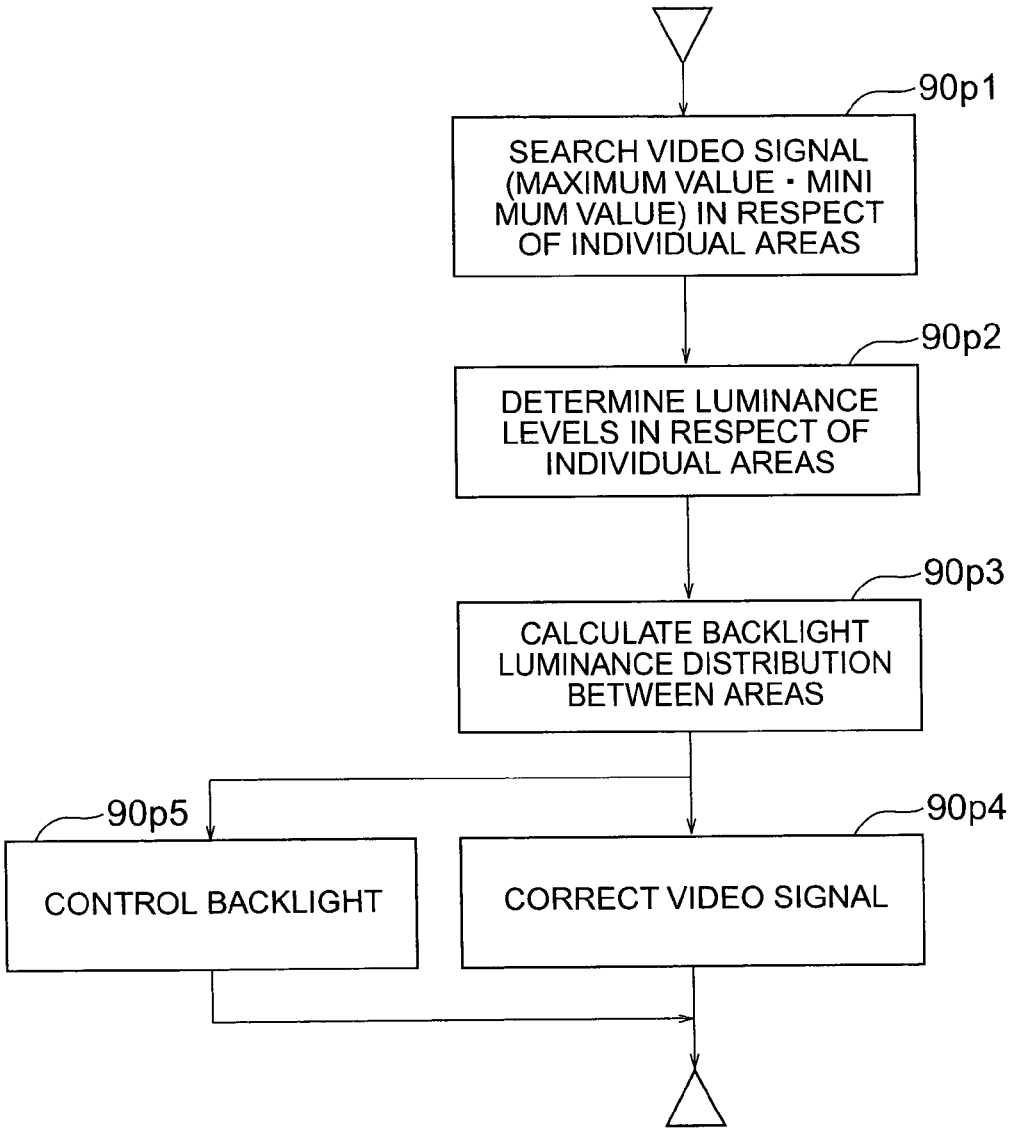
FIG. 13 is a schematic flowchart for explaining the operation of the video display apparatus according to the invention.

Referring to FIG. 13, there is illustrated a schematic flowchart for explaining the operation of the FIG. 12 circuit construction. Firstly, in the luminance distribution calculating means 50, an analytical search for maximum/minimum values for individual areas of a pixel signal s10 from the video signal processing means 30 is executed (90*p*1), a luminance level of backlight of each area is determined on the basis of the analytical search as shown in FIG. 1 (90*p*2) and an inter-area backlight luminance distribution is calculated on the basis of the luminance level of each area as shown in FIG. 11B (90*p*3). Next, in the video correction means 60, one-frame delayed display data s20 from the frame memory 40 is corrected on the basis of a backlight luminance distribution data signal s30 for each area (90*p*4). Concurrently therewith, in the backlight control means 80, backlight control is carried out on the basis of the backlight luminance distribution data signal s30 and area identifying signal s40 of each area (90*p*5). Accordingly, an output picture removed of irregularities as shown in FIG. 9D can be obtained. It will be appreciated that if the step (90*p*3) of calculating the inter-area backlight luminance distribution is omitted, an output picture as shown in FIG. 6D will be obtained on the supposition that the luminance of backlight between areas changes stepwise.

Figure 14:
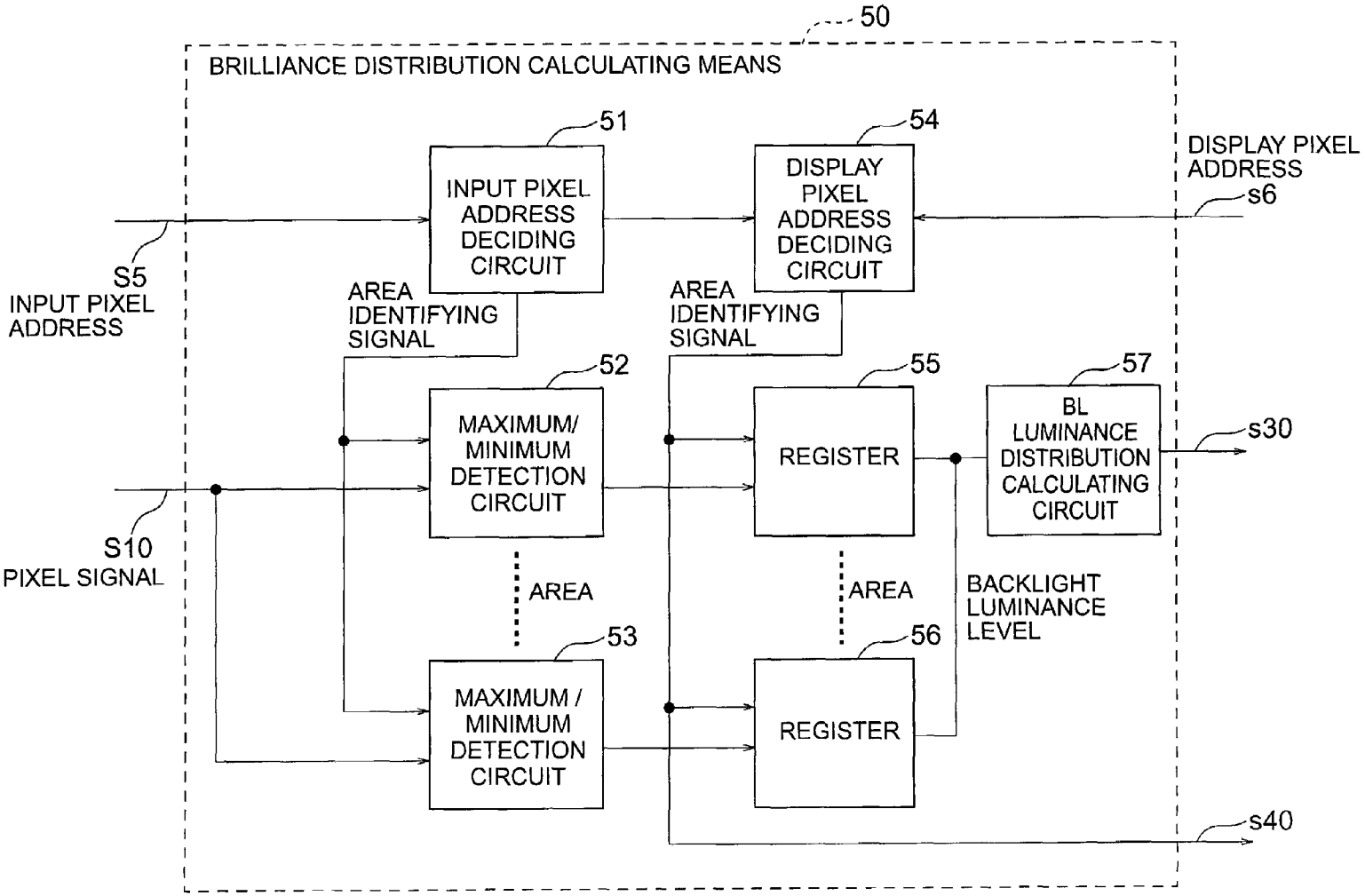
FIG. 14 is a block diagram showing a circuit construction of luminance distribution calculating means 50 shown in FIG. 12.

Referring to FIG. 14, there is illustrated a detailed circuit construction of the luminance distribution calculating means 50. Firstly, when an input pixel address s5 is inputted, an input pixel address deciding circuit 51 generates an area identifying signal indicating which one of the areas the input pixel exists in and this area identifying signal is supplied to maximum/minimum detection circuits 52 to 53 provided in correspondence with the individual areas to detect a maximum/minimum value of a pixel signal s10. The maximum/minimum detection circuits 52 to 53 analytically search a maximum value/minimum value of the pixel signal present in each area and store data of maximum value/minimum value of each area in registers 55 to 56 corresponding to the individual areas.

Next, when receiving a display pixel address s6, a display pixel address deciding circuit 54 generates an area identifying signal s40 and reads data of maximum value/minimum value stored in the register 55 and corresponding to the display area to determine a level of backlight luminance for that display area. The level is inputted to a backlight luminance distribution calculating circuit 57 to cause it to deliver a luminance distribution data signal s30 for each display area. An average value may be calculated from maximum values/minimum values for the individual display areas or a range of luminance level may be calculated from maximum value/minimum values for the whole of the display areas.

Figure 15:
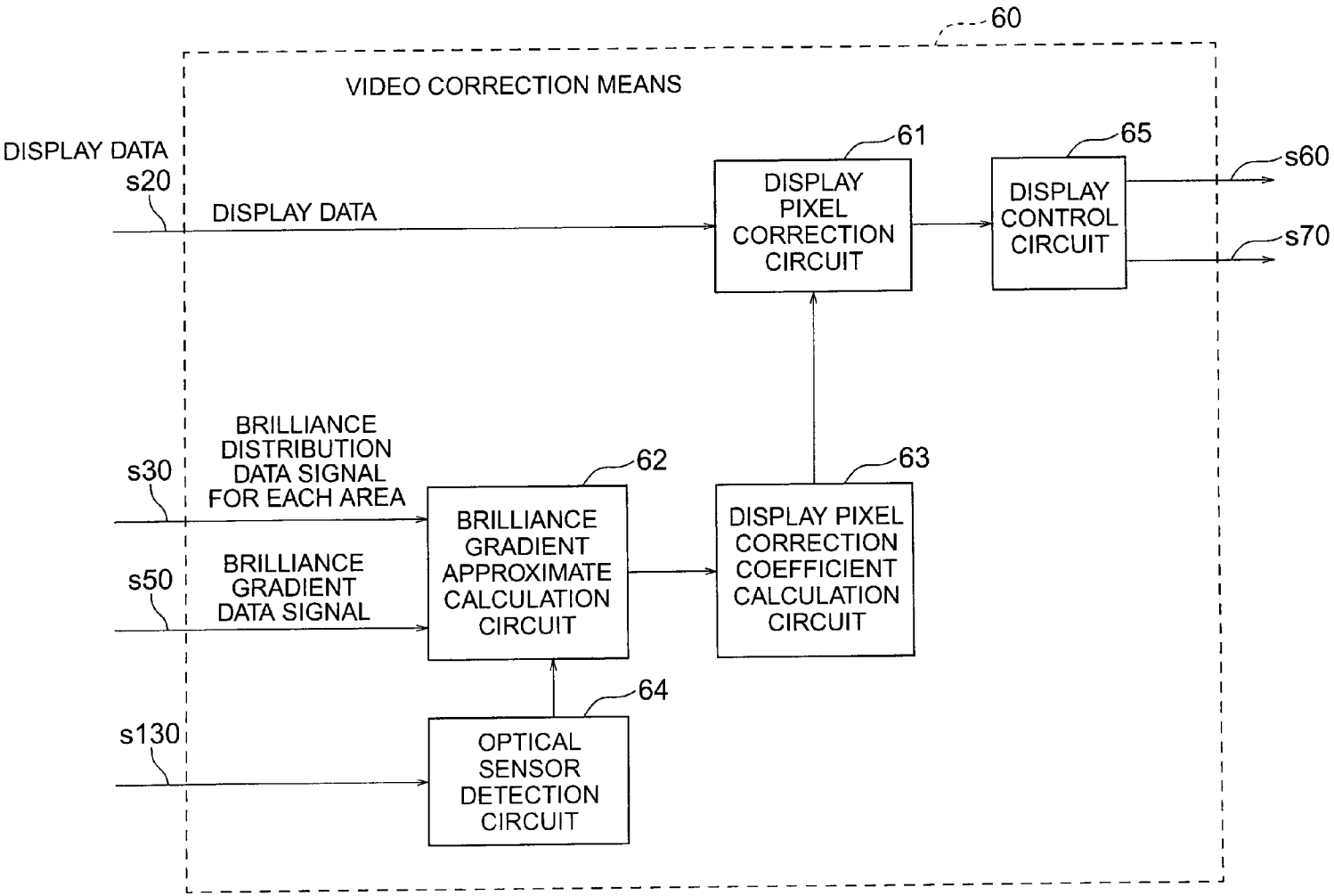
FIG. 15 is a block diagram showing a circuit construction of video correction means 60 shown in FIG. 12.

Referring to FIG. 15, there is illustrated a detailed circuit construction of the video correction means 60. Firstly, a luminance gradient approximate calculation circuit 62 responds to a backlight luminance distribution data signal s30 of each area and a brilliancy gradient data signal s50 stored in the correction memory 70 to approximately calculate a luminance gradient. A display pixel correction coefficient calculating circuit 63 calculates a correction coefficient from the luminance gradient and a display pixel correction circuit 61 corrects display data s20 on the basis of the correction coefficient. A display control circuit 65 converts the corrected data into timing signal s60 and data signal s70 for the LCD panel. A sensor signal s130 from the sensor arranged at the predetermined location of LED panel 20 is converted by an optical sensor detection circuit 64 and utilized by the luminance gradient approximate calculation 62 so as to reduce irregularities of lighting due to a difference in LED characteristic to advantage.

Figure 16:
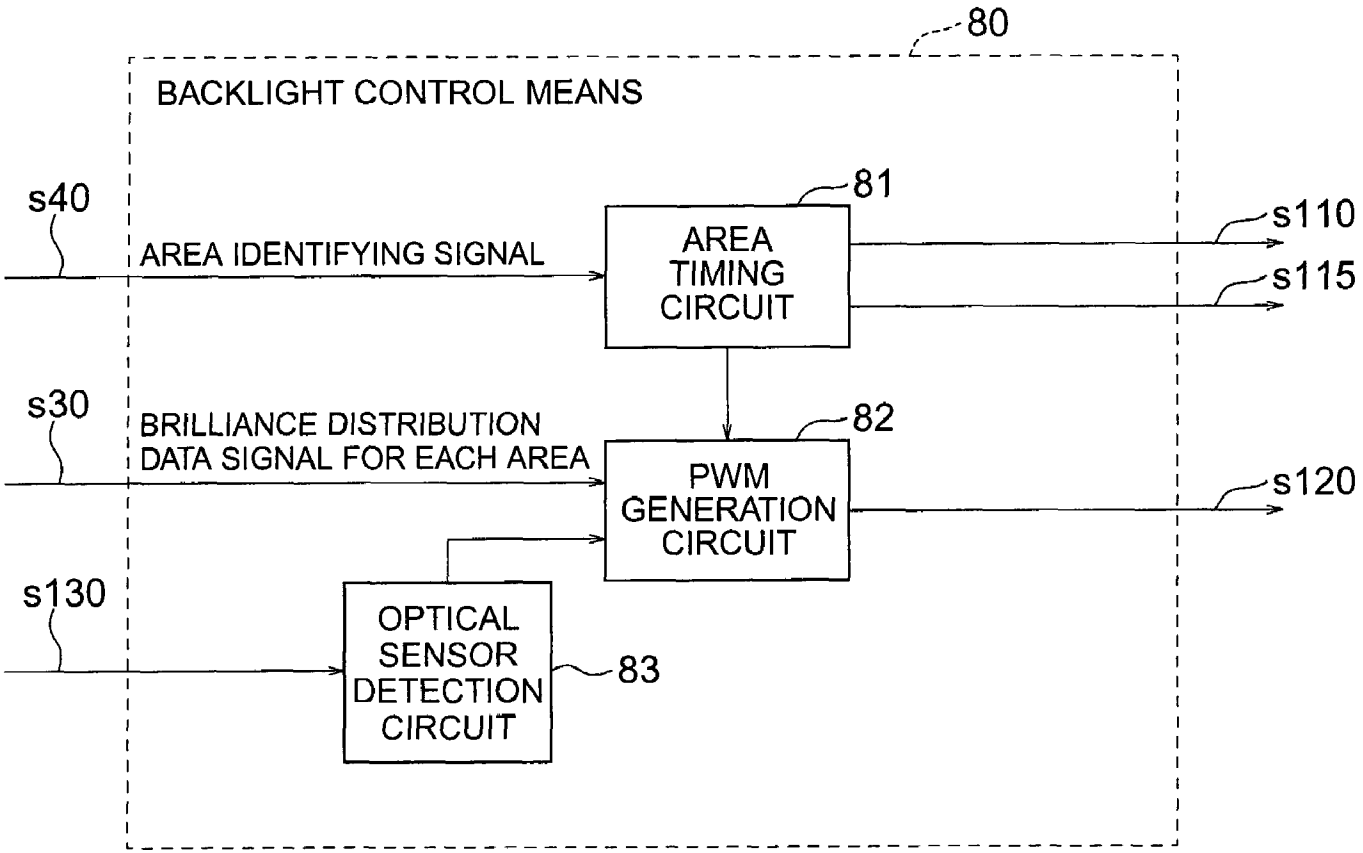
FIG. 16 is a block diagram showing a circuit construction of backlight control means 80 shown in FIG. 12.
Figure 17A:
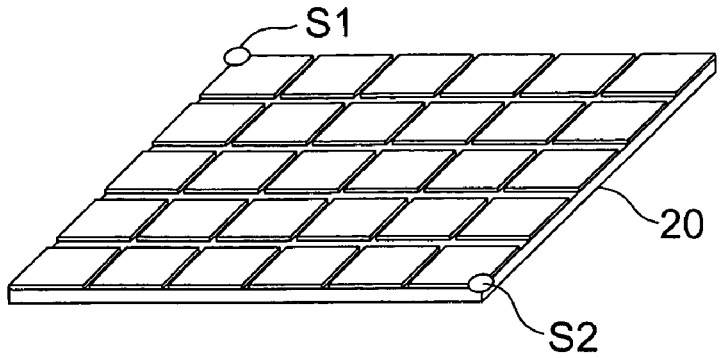
FIG. 17A to 17D are diagrams showing examples of arrangement of optical sensors.
Figure 17B:
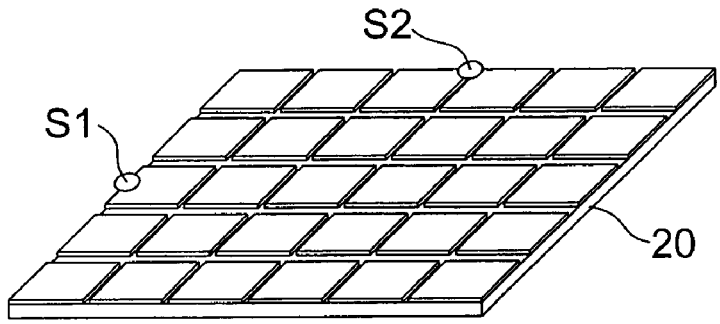
Figure 17C:
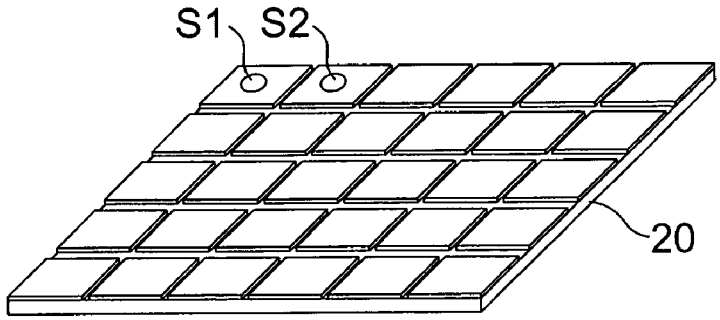
Figure 17D:
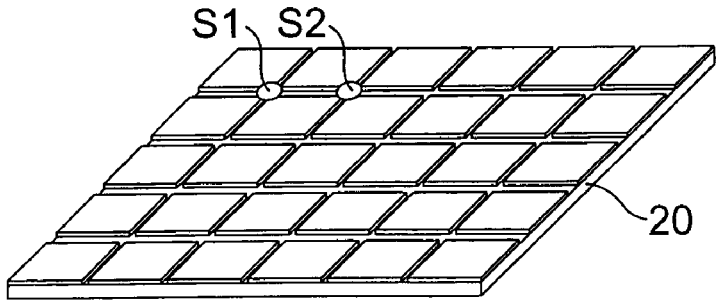

Turning to FIG. 16, a circuit of the backlight control means 80 is detailed therein. An area identifying signal s40 is inputted to an area timing circuit 81 and is delivered out thereof to provide a row driver signal sl10 and a column driver signal s115 for the LED panel 20. A backlight luminance distribution data signal s30 for each area is inputted to a pulse width modulation (PWM) generation circuit 82 and is delivered out thereof to provide a PWM signal 120. Like the video correction means 60, the backlight control means 80 also receives a sensor signal s130 at an optical sensor detection circuit 83 to apply a modification to the pulse width modulation (PWM) generation circuit 82. In this manner, irregularities of lighting due to the difference of LED characteristic can advantageously be reduced.

Examples of locations where optical sensors are arranged on the LED panel 20 will be explained with reference to FIGS. 17A to 17D. Optical sensors are located at corners (S1 and S2) of the LED panel 20 in an example shown in FIG. 17A, they are located on sides (S1 and S2) of the LED panel 20 in an example shown in FIG. 17B, they are located in the central portions (S1 and S2) of the partitive areas in an example shown in FIG. 17C and they are located on the respective boundaries between partitive areas (S1 and S2) in an example shown in FIG. 17D. In the individual examples as above, two sensors are arranged but the number of sensors to be arranged is not limited thereto and two or more sensors may be distributed in consideration of balance.

Embodiment 3

Figure 18:
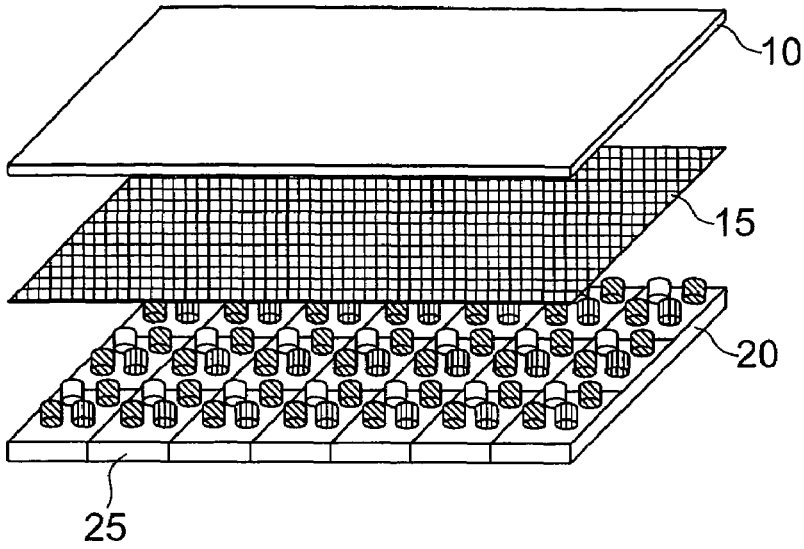
FIG. 18 is an exploded perspective view showing a structure when LED's are used for backlight according to an embodiment of the present invention.

An embodiment of the lighting unit (backlight) will be described with reference to FIG. 18 through FIG. 29. A partitive area type backlight using light emitting diodes LED's is constructed as shown in FIG. 18 to function as a light emitting device for emitting illumination light. The LED panel 20 is divided into predetermined areas 25 and a plurality of (here, four) LED's are arranged in each area 25. The LED panel 20 is disposed immediately beneath the LCD panel 10 and a luminance distribution for individual areas 25 can be uniformed through the medium of a light diffusing sheet 15.

Figure 19:
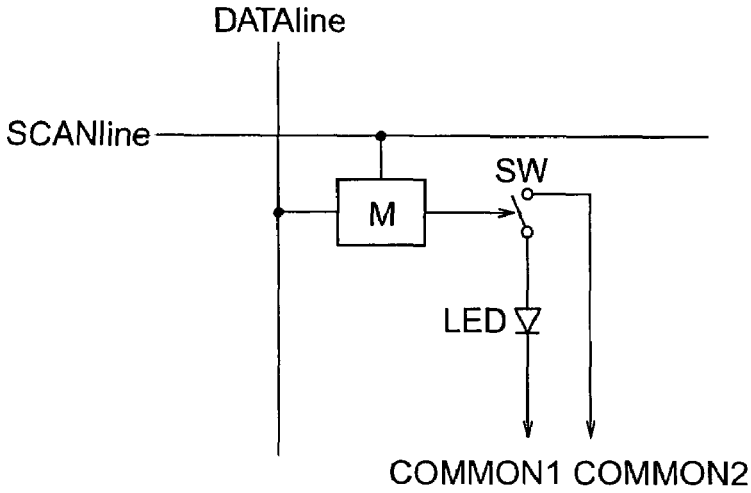
FIG. 19 is a conceptual circuit diagram showing control of an LED based on matrix drive mode.

A basic model of matrix divie mode for the LED panel 20 is depicted in FIG. 19. As shown, a switching element M is disposed at an intersection of data line (DATAline) and scan line (SCANline) to switch on/off a switch SW in accordance with a potential difference between the data line (DATAline) and the scan line (SCANline). An electrical potential develops across two common electrode lines (COMMON1 and COMMON2), so that when the switch SW is turned on, a light emitting diode LED is lit. In case a transistor is used as the switching element M, the active matrix drive mode can be materialized. If the data line (DATAline) and scan line (SCANline) are connected to the anode and cathode of the LED, respectively, and a potential difference between these electrodes is controlled, then the switching element M can be dispensed with. In this case, the passive matrix drive mode can be materialized.

Figure 20:
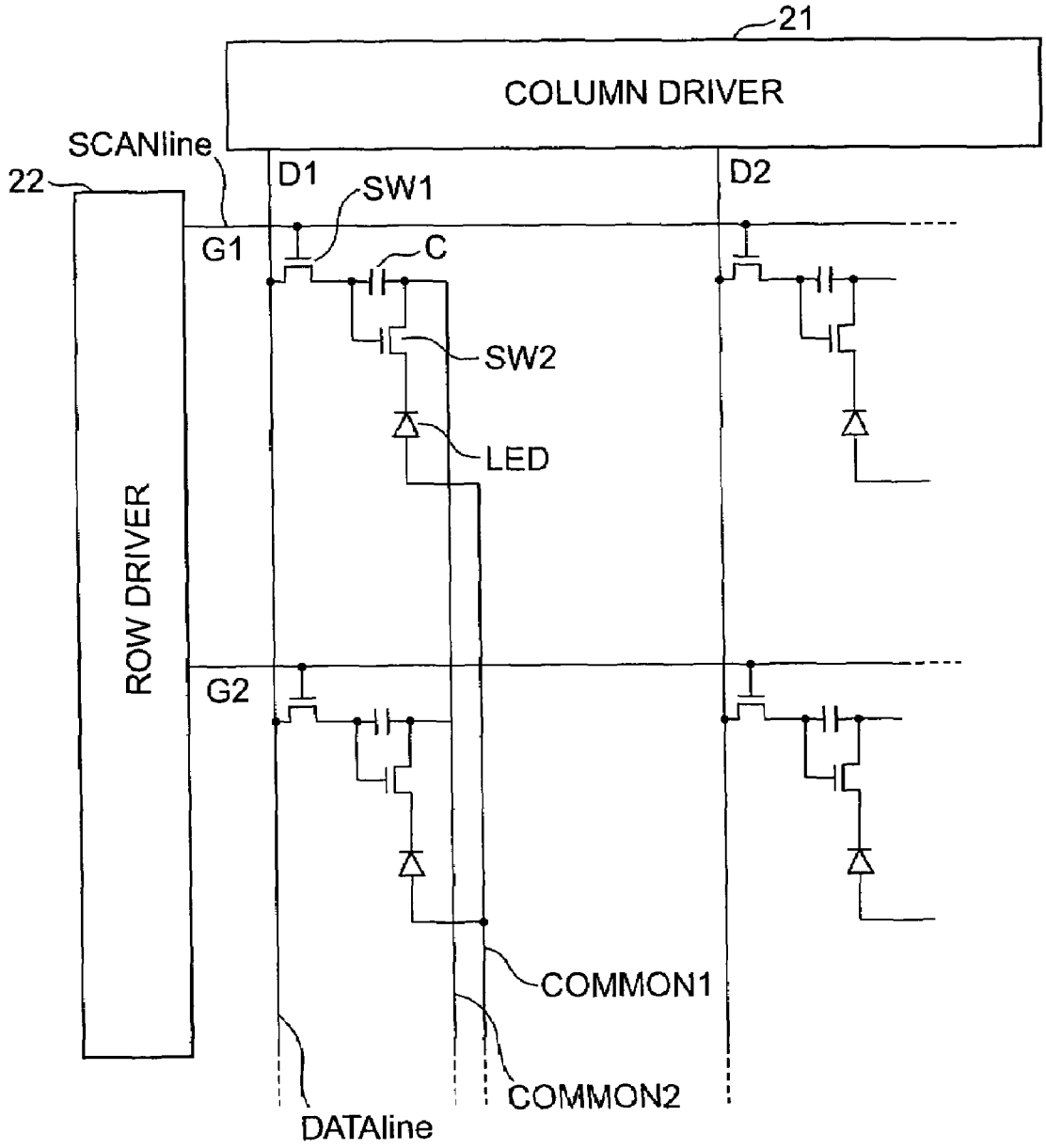
FIG. 20 is a circuit diagram showing the construction for realizing LED control based on active matrix drive mode.

A concrete circuit diagram of the active matrix drive mode LED panel 20 is illustrated in FIG. 20. Connected to respective intersections of data lines (D1, D2, . . . ) and scan lines (G1, G2, . . . ) are a transistor switch SW1 to be turned on/off selectively by the data line and scan line, a capacitor C charged with an electric charge when the switch SW1 is turned on, a transistor switch SW2 to be turned on by a potential difference across the charged capacitor C and a light emitting diode LED to be lit when the switch SW2 is turned on. The light emitting diode LED is connected to two common electrodes (COMMON1 and COMMON2) and is lit by a potential difference across the common electrodes.

Figure 21A:
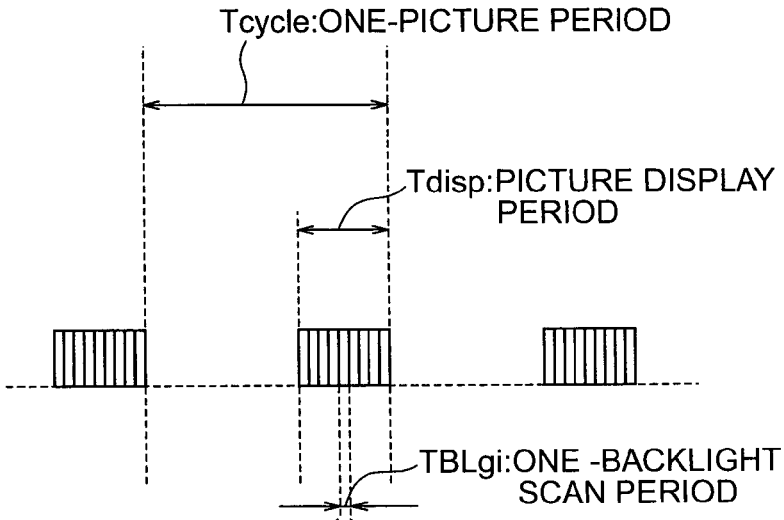
FIGS. 21A and 21B are time charts of LED control based on PNM scheme.
Figure 21B:
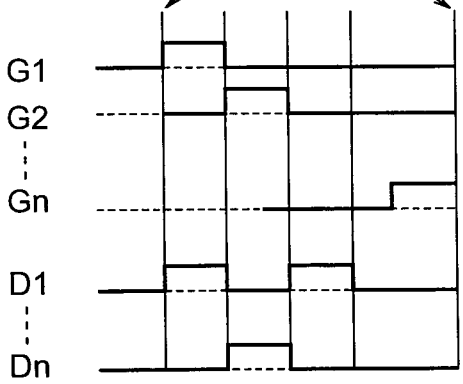

In the active matrix drive mode shown in FIG. 20, lighting of the light emitting diode LED is controlled on the basis of pulse number modulation (PNM) in accordance with time charts shown in FIGS. 21A and 21B. As illustrated in FIG. 21A, a picture is displayed during a picture display period (Tdisp) at intervals of one-picture periods (Tcycle) of a video signal, that is, period for changing write of one screen or frame. In this example, for the purpose of suppressing a blur persons feel during a display of motion picture, Tdisp<Tcycle is held. In a time chart shown in FIG. 21B, one period of a backlight scan (TBLgi), which is a part of the image display period (Tdisp), is enlarged, indicating that during this period, G1, G2, . . . , Gn are delivered from the scan lines of row driver 22 shown in FIG. 20 and D1, . . . , Dn are delivered from the data lines of column driver 21 shown in FIG. 20. In the pulse number modulation (PNM), the number of pulses inputted to the LED during one picture display period (Tdisp) is controlled in order that lighting time can be adjusted to change the backlight luminance. Needless to say, an LED to which a larger number of pulses are inputted during one picture display period (Tdisp) can have a higher luminance level.

Figure 22:
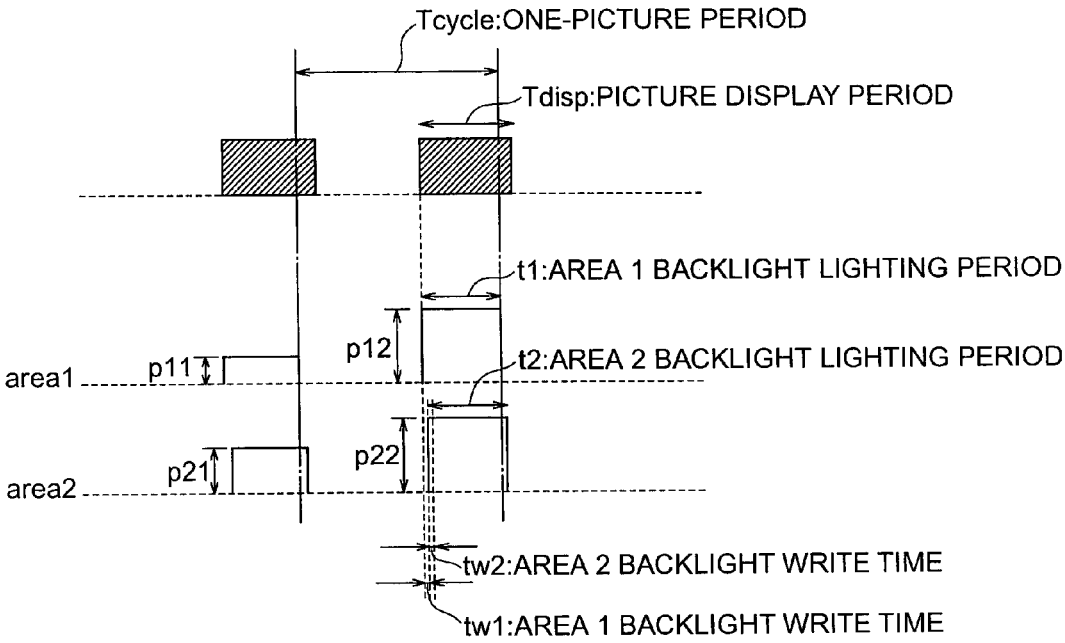
FIG. 22 is a time chart of LED control based on PAM scheme.

To describe another embodiment of the active matrix drive mode shown in FIG. 20, a time chart of the PAM (pulse amplitude modulation) mode is illustrated in FIG. 22. Here, an LED in area1 is driven by data line D1 and scan line G1 shown in FIG. 20 and an LED in area2 is driven by data line D1 and scan line G2 shown in FIG. 20. The capacitor shown in FIG. 20 is charged with an electric charge in accordance with a potential difference between the connected data line and scan line and holds this potential difference for a constant period. The resistance of the transistor SW2 changes with this potential difference. This action can ensure that even after the transistor SW1 is turned off in accordance with the potential difference between the data line and scan line, the potential difference can be applied to the LED for a constant period.

This operation is indicated in the time chart of FIG. 22. In the figure, voltages (p11 and p12) applied to the LED in area1 and voltages (p21 and p22) applied to the LED in area2 are depicted. Obviously, the higher the applied voltage, the higher the luminance becomes. Also, as shown in the figure, a constant write time is needed before a voltage is applied to the LED following application of the potential difference between data line and signal line.

Accordingly, in the case of actual drive, a potential difference is applied across the data line D1 and the scan line G1 in FIG. 20 and thereafter a potential difference is applied between the data line D1 and the scan line G2 at the termination of write time tw1. As a result, a timing of starting lighting the LED in area2 shifts by tw1 from that for the LED in area1 but this time difference is too small to affect the picture quality.

Figure 23:
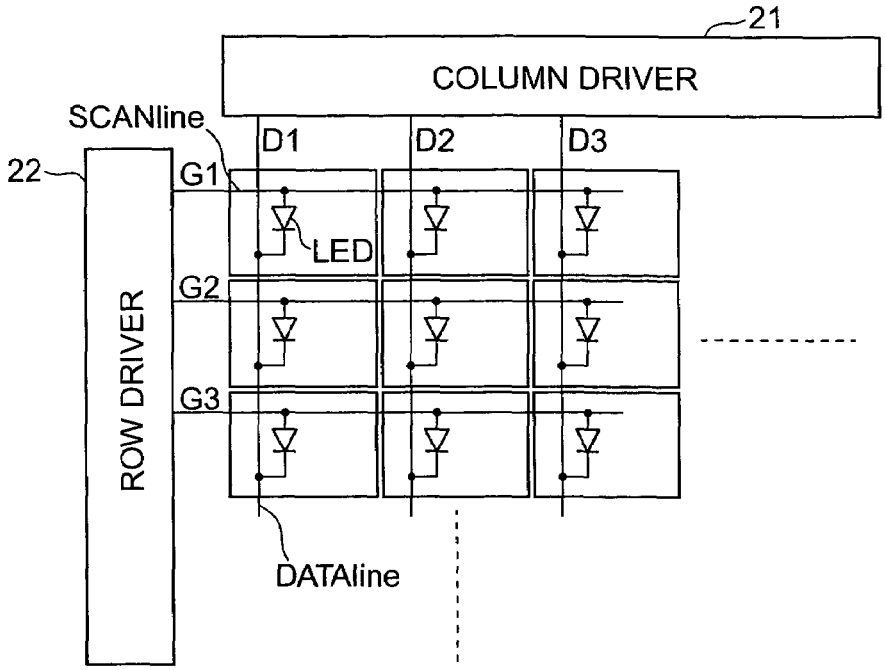
FIG. 23 is a circuit diagram showing the construction for realizing LED control based on passive matrix drive mode.

A circuit construction of the passive matrix drive mode is illustrated in FIG. 23. In this mode, only light emitting diodes LED's are provided in matrix, so that with data lines (D1, D2, D3, . . . ) connected to a column driver 21 and scan lines (G1, G2, G3, . . . ) connected to a row driver 22, light emitting diodes LED's are disposed at intersections of these data lines and scan lines.

Figure 24:
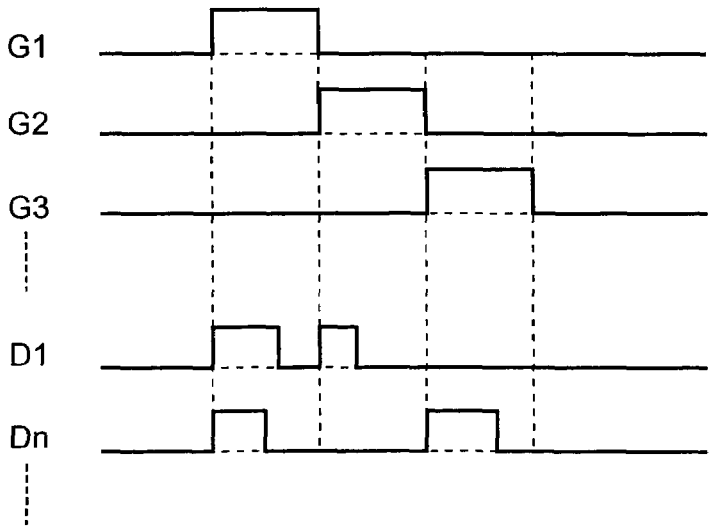
FIG. 24 is a time chart of LED control based on the passive matrix drive mode.

In the passive matrix drive mode shown in FIG. 23, lighting of the light emitting diodes LED's is controlled on the basis of pulse width modulation (PWM) scheme in accordance with a time chart shown in FIG. 24. Generally, this control is effected in the scroll control mode. More particularly, the scan lines (G1, G", G3, . . . ) are sequentially selected to scan one frame of a picture. Then, when a potential develops at a data line (D1, D2, . . . ), a light emitting diode LED is lit. In the pulse width modulation (PWM), the lighting time can be adjusted by controlling the pulse width to thereby change the backlight luminance. Obviously, the longer the pulse width, the higher the luminance becomes.

Figure 25:
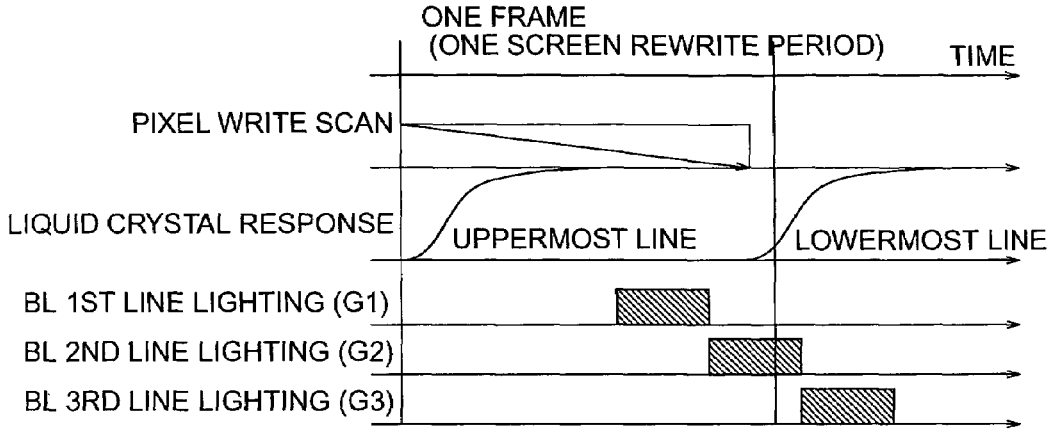
FIG. 25 is a time chart showing LED control based on the passive matrix mode by making the correspondence with liquid crystal response.

In FIG. 25, a time chart of passive matrix drive mode is illustrated by making the correspondence between the LCD panel side (pixel write/scan and liquid crystal response) and the backlight side (lighting on BL $1^{st}$ line (G1), lighting on BL $2^{nd}$ line (G2), . . . ). Pixel write/scan is applied to the LCD panel sequentially from upper line to lower line.

However, a time is required for liquid crystal response and therefore, as shown in FIG. 25, light transmission can proceed sequentially from the uppermost line to the lowermost line. If the backlight is lit before the liquid crystal response is stabilized, this will cause a motion picture to blur and therefore, in FIG. 25, backlight is lit after the liquid crystal response of pixels contained in the backlight area is stabilized. As a result, the control is such that lighting of the backlight is scrolled in the row direction.

Figure 26:
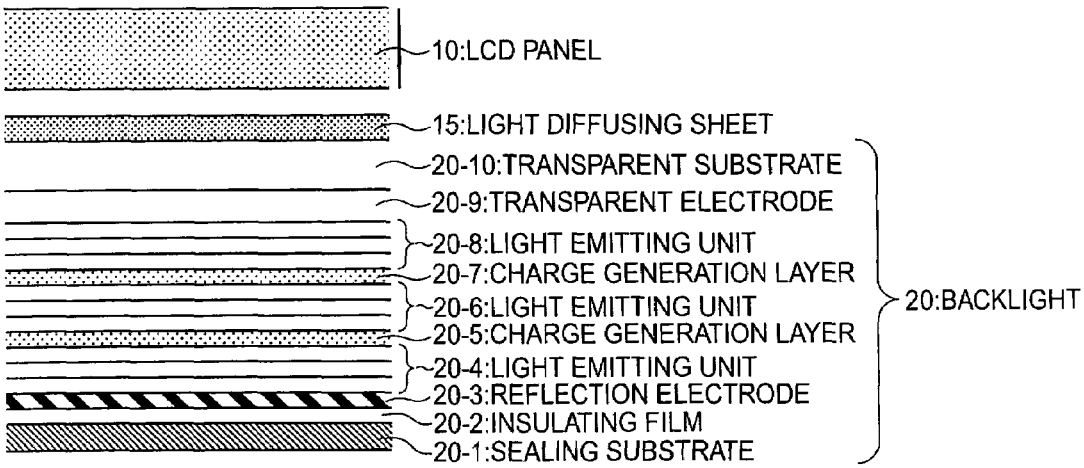
FIG. 26 is a diagram showing a structure of an embodiment of the invention when organic EL elements are used for a backlight.

An example of a backlight for which organic EL devices are used is constructed as illustrated in schematic sectional form in FIG. 26. A backlight 20 includes a sealing substrate 20-1 made of a material such as metal having high heat conduction property and gas barrier property in consideration of attainment of a high heat dissipation characteristic, an insulating film 20-2, a reflection electrode 20-3 made of light reflective metal, light emitting units 20-4, 20-6 and 20-8 and charge generation layers 20-5 and 20-7, a transparent electrode 20-9 made of a light transmissible, electrically conductive material and a transparent substrate 20-10 made of glass or plastic having transparency and gas barrier property.

The device having a multiple layer structure of light emitting units and charge generation layers is called a multi-photon organic EL device and can obtain a high lighting efficiency (cd/A) in accordance with the number of layers of lighting units and charge generation layers as described in, for example, SID03, DIGEST, pp. 946-965, finding suitability for the backlight according to the invention.

When DC voltage is applied across the reflection electrode 20-3 and transparent electrode 20-9 to cause current to flow through the multiple layer structure, the respective light emitting units 20-4, 20-6 and 20-8 are lit and the device can function as backlight. The backlight 20 is disposed with the transparent substrate 20-10 confronting an LCD panel 10 and a light diffusing sheet 15 is interposed, as necessary, between the LCD panel 10 and the backlight 20.

Figure 27:
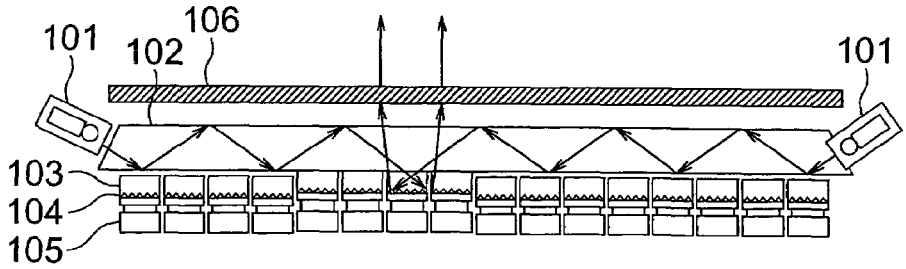
FIG. 27 is a sectional view of a backlight based on LED edge type.

A partitive area backlight of LED edge type serving as a lighting unit is illustrated in sectional form in FIG. 27. LED's 101 are arranged at opposite sides of the backlight panel. Light rays from the LED's 101 propagate through a light-guide portion 102 and reflected at reflectors 104 of a reflection portion 103 so as to go out of the surface via a light diffusing sheet 106. When a reflector 104 in the center is thrown on, light rays are caused to go out. The reflectors 104 are movable vertically in cooperation with drive members 105. Since the LED's are controlled area by area, they are packaged as an array-like module.

Figure 28:
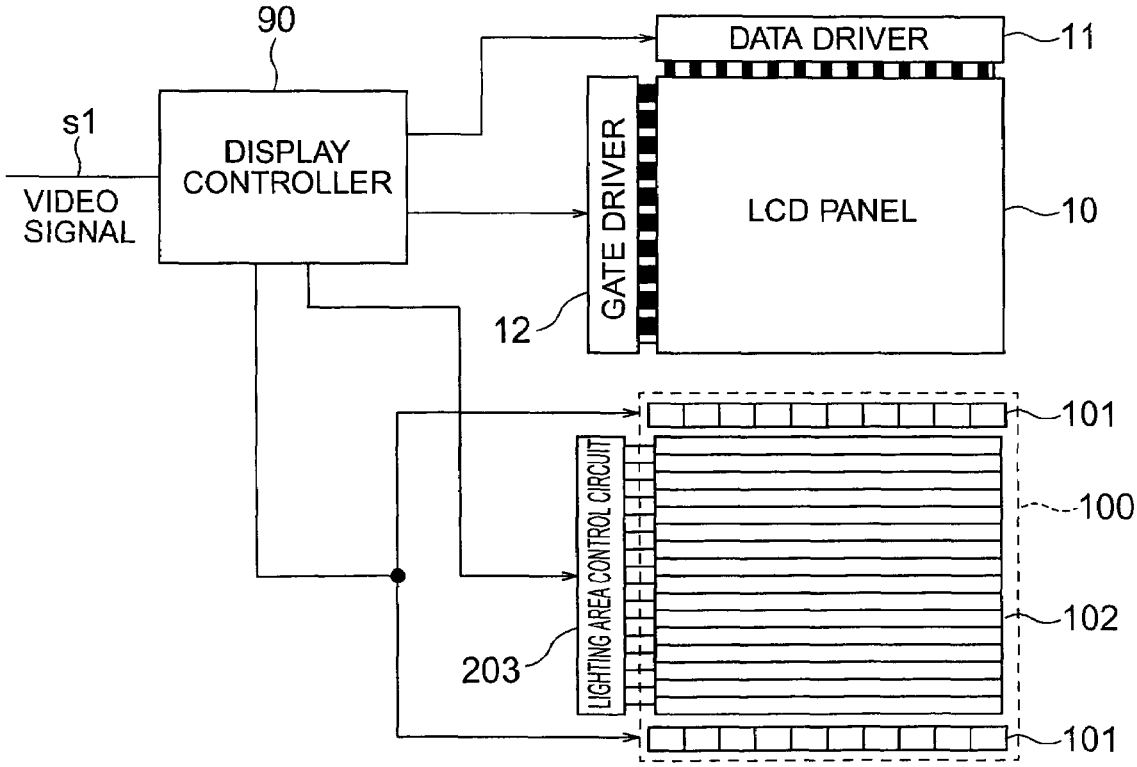
FIG. 28 is a block diagram showing the overall circuit construction in the LED edge type.

An overall circuit construction when the LED edge type shown in FIG. 27 is used is illustrated in FIG. 28. Sidelight LED's 101 arranged on opposite ends of a backlight portion 100 are controlled by the display controller 90 detailed in FIG. 12. The display controller 90 also controls the data driver 11 and gate driver 12 to display a picture corresponding to a video signal s1 on the LCD panel 10. Further, the display controller 90 controls a lighting area control circuit 203 which in turn drives drive members 105 shown in FIG. 27.

Figure 29:
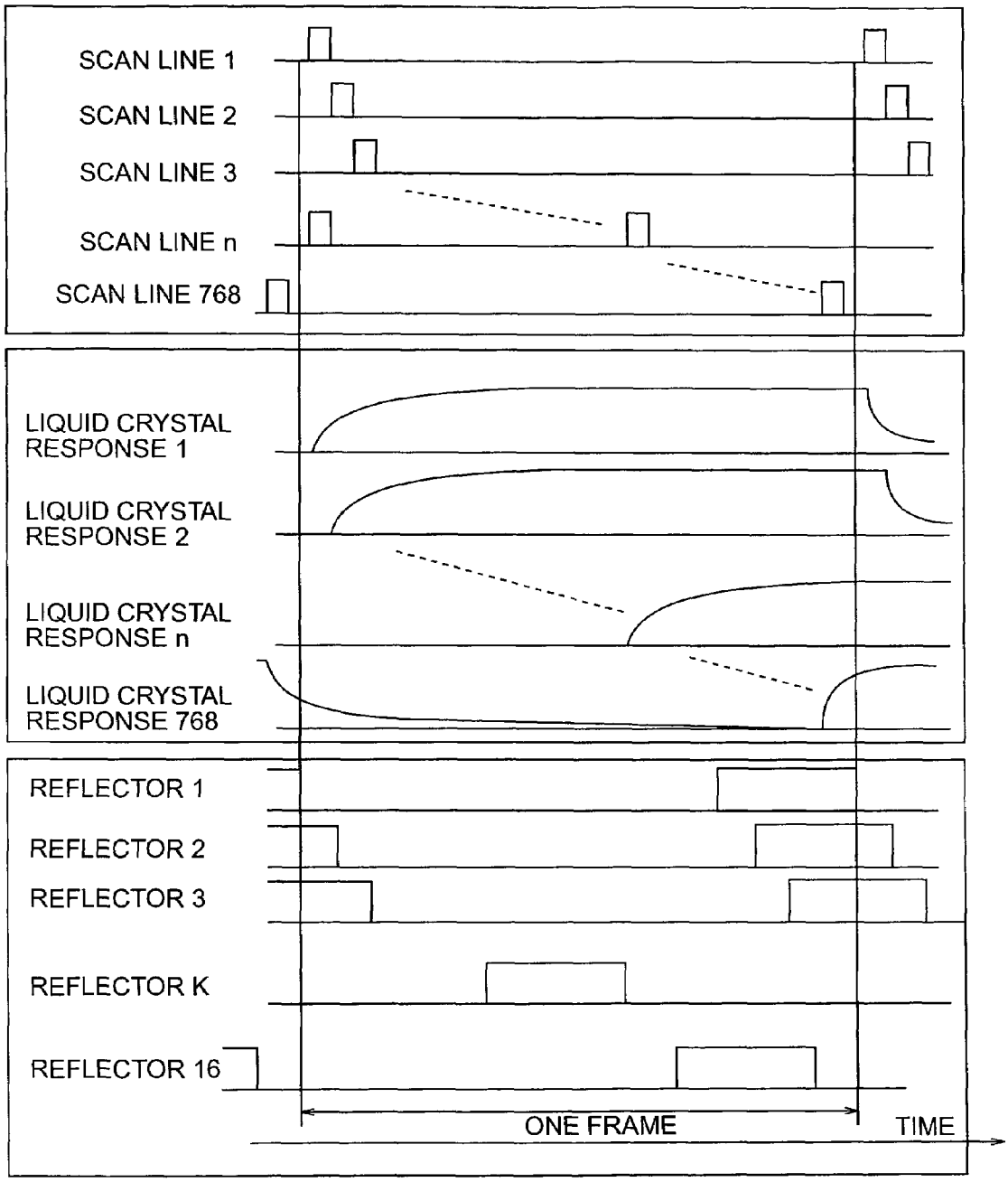
FIG. 29 is a time chart for one frame in the LED edge type.

A time chart in the LED edge type shown in FIG. 28 is illustrated in FIG. 29 by making the correspondence between the LCD panel side (scan lines and liquid crystal response) and the backlight side (reflectors). When scan lines 1, 2, 3 . . . n . . . 768 connected to the LCD panel 10 are turned on, liquid crystal responses 1, 2, 3 . . . n . . . 768 are started and with the liquid crystal responses stabilized, reflectors 1, 2, 3 . . . k . . . 16 are turned on. When the reflector is turned on, light is emitted and a picture is displayed.

In the foregoing, the light emitting diodes and organic EL elements are used for light sources of the lighting unit but alternatively, cold cathode fluorescent lamps (CCFL's) may substitute for the above light sources to attain high luminance to advantage.

Embodiment 4

A view field angle characteristic matters in the liquid crystal display device used for the video display apparatus according to this invention. This problem will be studied hereinafter and an embodiment of the invention for eliminating the problem of view field angle characteristic will be described with reference to FIGS. 30 to 33.

Figure 30B:
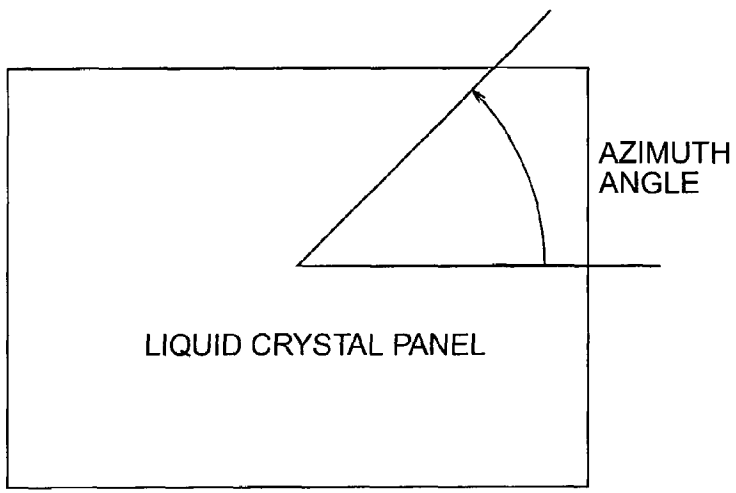
FIGS. 30A and 30B are diagrams for explaining view field angle.
Figure 30A:
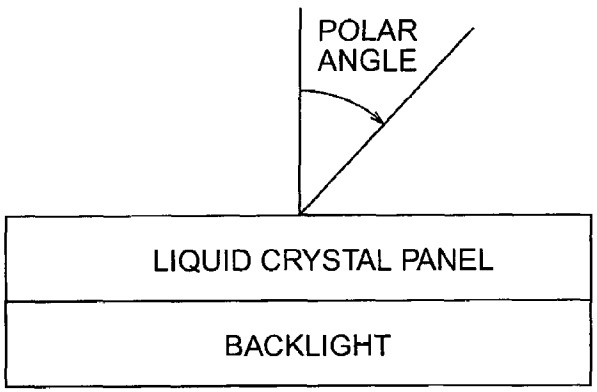
Figure 31:
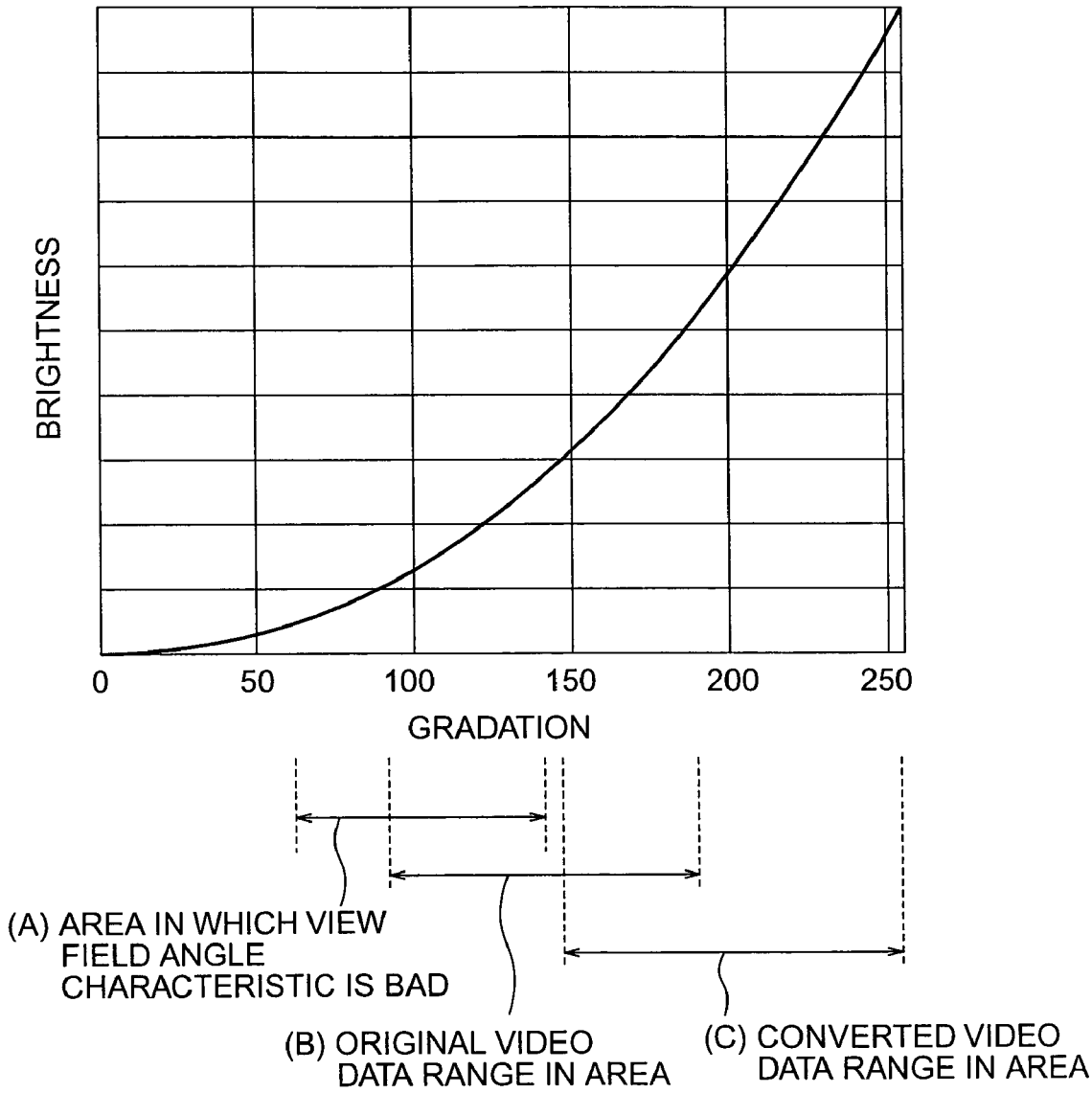
FIG. 31 is a graph showing the concept of tendency of view field angle characteristic in a general liquid crystal display apparatus.

In general, existing liquid crystal display apparatus face a common problem that a picture is seen differently in accordance with a view field angle as shown in FIG. 30. Most of the existing liquid crystal display apparatus have a favorable display area (c) and an unfavorable display area (a) as shown in FIG. 31. The favorable display area and unfavorable display area change depending on the liquid crystal display mode.

Figure 32:
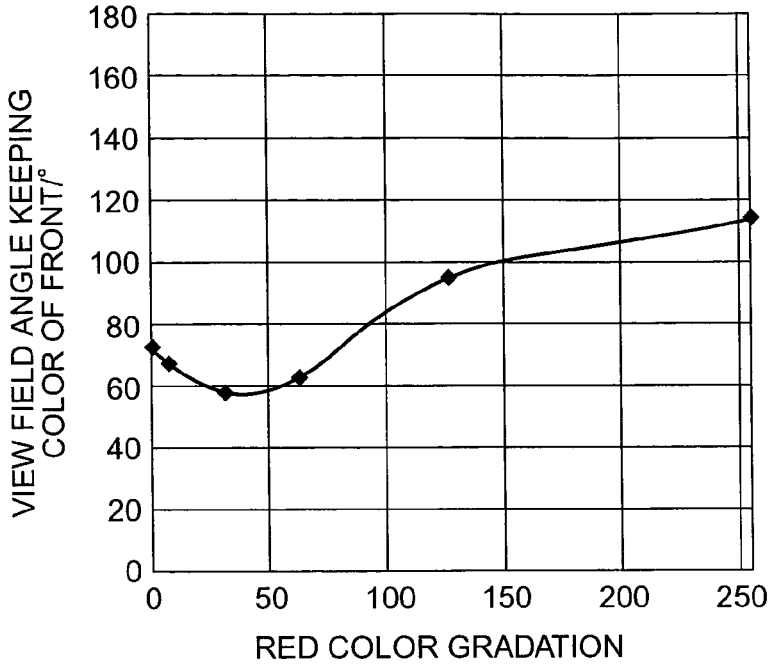
FIG. 32 is a graph showing the dependency of color difference view field angle characteristic upon gradation when red color is displayed in general 1PS type.

A view field angle characteristic of red color in the IPS (in-plane switching) mode, which is one of the lateral electric field switching type, is graphically illustrated in FIG. 32. In the figure, abscissa represents the red color gradation (red color monochrome) and ordinate represents the angular range within which the same color as that seen from the front of the liquid crystal display panel can be seen when the color seen from the front is seen at different angles in lateral direction and upwardly oblique direction. In other words, within this angular range, a picture can be seen in the same color as that seen from the front. This range is determined under a condition that a value of means square of a difference between a CIE1976 u'v' chromaticity coordinate value measured from the front and a u'v' chromaticity coordinate value measured by changing the angle is less than 0.02. Hereinafter, this is called a color difference/view field angle characteristic. According to FIG. 31, in liquid crystal of IPS type used in the present embodiment, the color difference/view field angle characteristic is good in areas of more than 100 gradation level up to 255 gradation level and slightly falls in areas of less than 100 gradation level.

Figure 33:
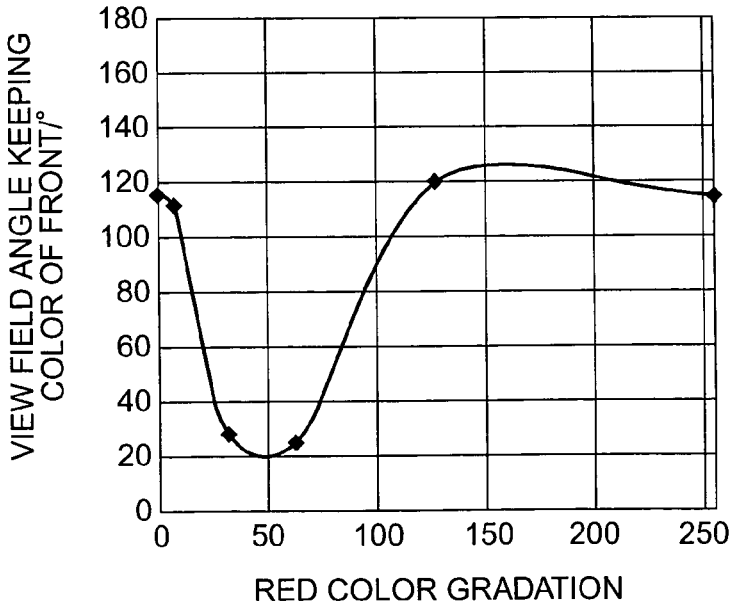
FIG. 33 is a graph showing the dependency of color difference view field angle characteristic upon gradation when red color is displayed in general VA type.

On the other hand, a color difference/view field angle characteristic of red color in the VA mode, which is one of the vertical electric field switching type, is graphically illustrated in FIG. 33, indicating that the color difference/view field angle characteristic greatly changes in areas of from low gradation to medium gradation.

Then, when video signals are concentrated on an unfavorable display area specific to each liquid crystal display mode (see (a) in FIG. 31), the backlight control means and video correction means according to the present invention convert the video signals without using the unfavorable display area to display pictures in the favorable area as shown at (c) in FIG. 31, thereby ensuring that an excellent display can be given for pictures in the areas originally unfavorable to the individual liquid crystal display modes. This conversion can be materialized using the luminance distribution calculating means 50, video correction means 60 and backlight control means 80 shown in FIG. 12. Namely, the video signal is corrected (raised) such that areas of excellent characteristic can be used to determine (lower) the backlight luminance.

Embodiment 5

Figure 34:
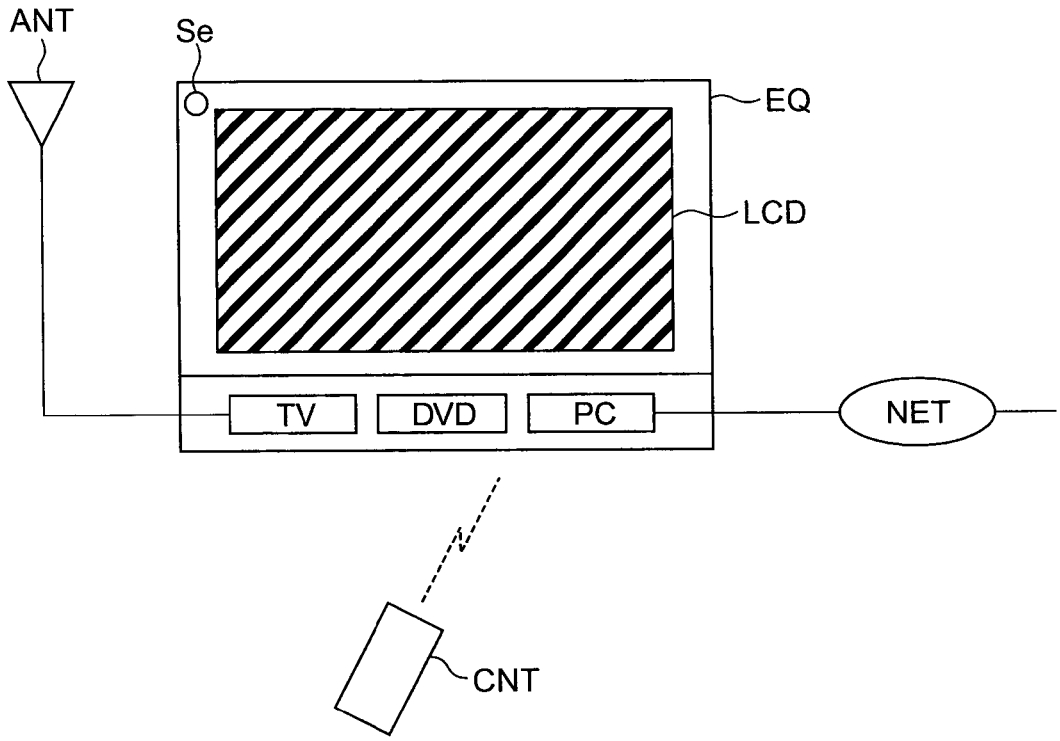
FIG. 34 is a diagram showing the construction of a TV apparatus to which the video display apparatus according to the invention is applied.

Referring now to FIG. 34, a TV apparatus to which the video display apparatus of this invention is applied is constructed as shown therein. A TV apparatus proper EQ includes a display device LCD, a tuner TV, a recorder DVD and a personal computer PC. A TV video signal is inputted from an antenna ANT and the PC is connected to Internet NET to play the role of home network and home theater. By using a remote controller CNT, the TV, DVD and PC can be switched freely to switchover various contents. Depending on contents, backlight of the display device LCD can be controlled by means of the remote controller CNT or the ambient light of a room can be detected by means of a sensor Se serving as a detection means, so that the backlight can be controlled automatically to provide an optimum picture. For example, during display of a motion picture, the luminance of the backlight can be so controlled as to prevent the motion picture from blurring or the backlight can be controlled in accordance with the ambient light of a room so that automatic switching to a picture optimized for persons can be done.

As described above, according to the present invention, the luminance of backlight is controlled and video correction is made correspondingly, with the result that the display luminance range can be widened and power consumption can be reduced while keeping the picture quality from degrading.

Embodiment 6

Figure 35:
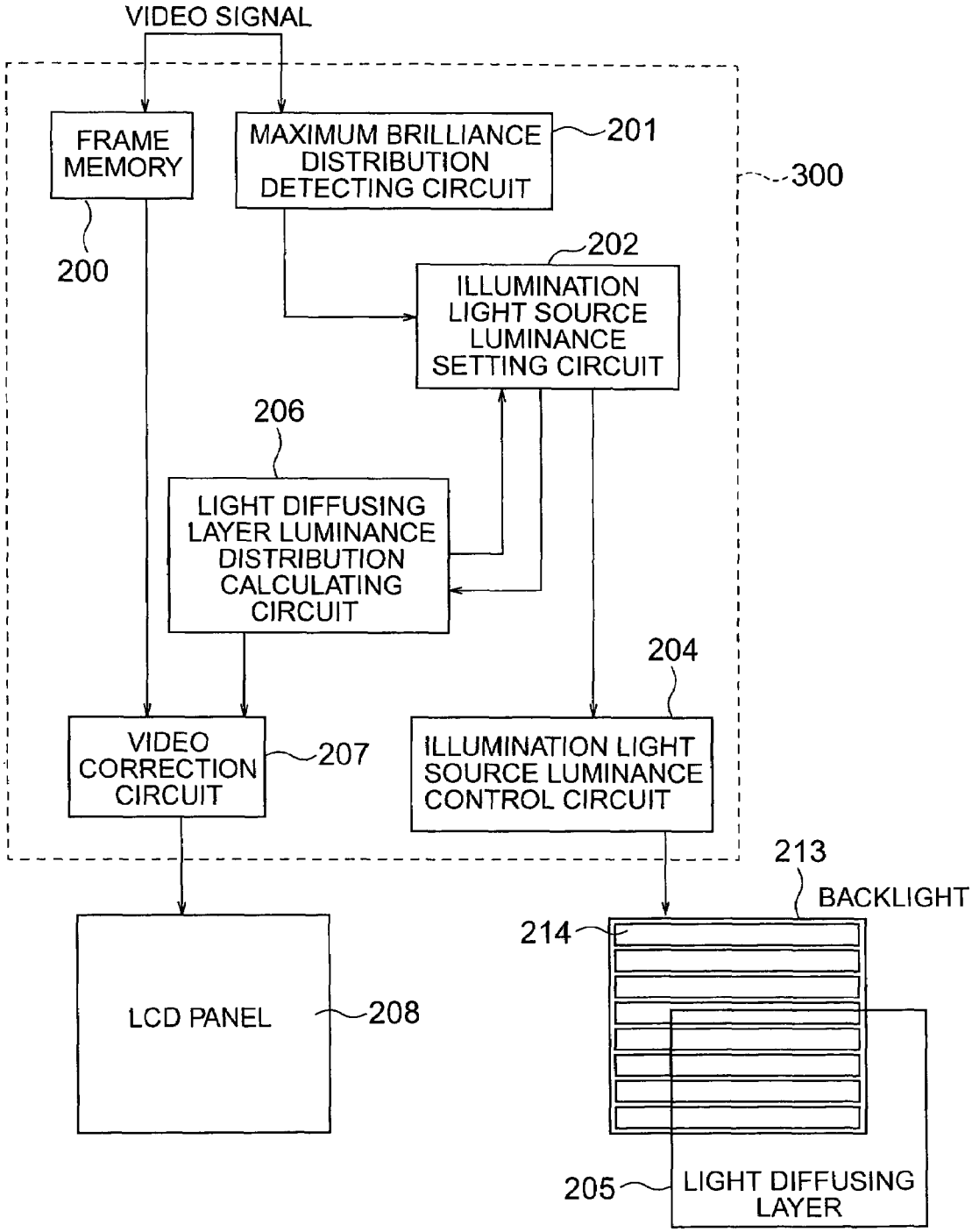
FIG. 35 is a block diagram showing an example of a video display apparatus according to the invention.

Embodiment 6 of this invention will now be described. A construction used for the present embodiment is illustrated in FIG. 35.

A display apparatus according to the present embodiment comprises a display device having an LCD panel 208 serving as light modulation device, a light source having a backlight 213, and a circuit section for controlling pictures of the display device and the luminance of the light source. The circuit section for controlling the picture and luminance is represented by a display processing circuit 300. The backlight 213 is divided into 8 light source areas 214 in the vertical scan direction, having LED light sources at respective partitive areas and a light diffusing layer 205 is disposed above the LED light sources. The LCD panel 208 causes rays of light on the light diffusing layer 205 to transmit through it to thereby display a picture. Characteristic of the present embodiment is that in the display processing circuit 300, luminance levels of the individual partitive areas of backlight 213 are controlled on the basis of a maximum luminance distribution for one frame. An example of internal construction of the display processing circuit 300 will be described.

The display processing circuit 300 includes a frame memory 200 for storing video signals, a maximum luminance distribution detecting circuit 201 for detecting a spatial distribution of maximum luminance from video signals being sent to the LCD panel, an illumination light source luminance setting circuit 202 for setting luminance levels of individual partitive areas, an illumination light source luminance control circuit 204 for controlling luminance levels of the illumination light source in respect of the individual partitive areas on the basis of the illumination light source luminance setting values set by the illumination light source luminance setting circuit 202, a light diffusing layer luminance distribution calculating circuit 206 for calculating a luminance distribution on the light diffusing layer 205 and a video signal correction circuit 207.

The individual circuit components operate as will be described below in greater detail.

Figure 36:
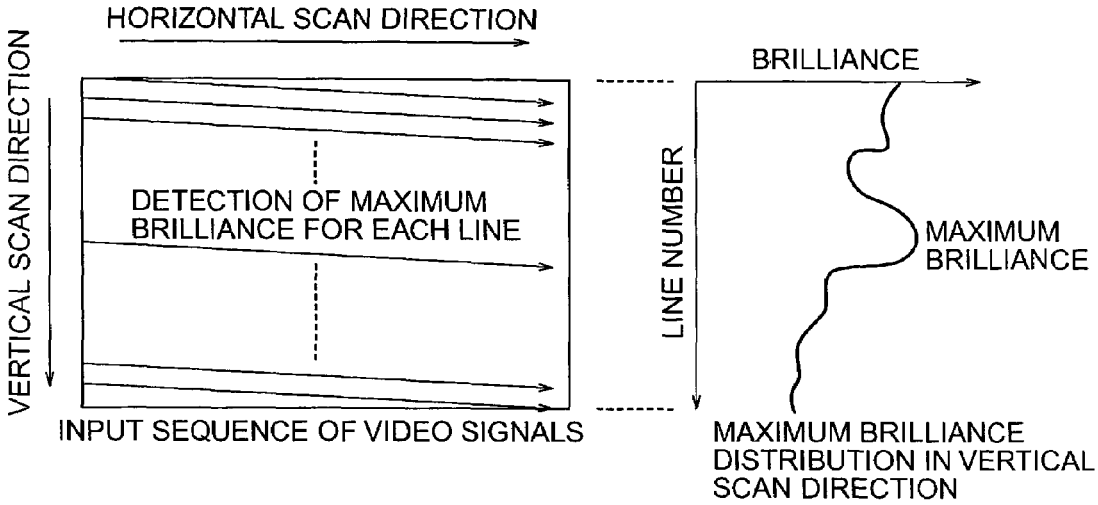
FIG. 36 is a diagram for explaining a method of detecting a maximum luminance of video signal.

Firstly, a method of calculating a spatial distribution of maximum luminance on the screen by the maximum luminance distribution detecting circuit 201 will be described with reference to FIG. 36. A video signal for one line is sent to the LCD panel during one horizontal scan period and this operation repeats itself by at least the number of all lines to complete one vertical scan. The maximum luminance distribution detecting circuit 201 reads a video signal for one line during each horizontal period to detect a video signal (portion) exhibiting the highest luminance on the line. By repeating this operation by the number of all lines, a video signal distribution indicating maximum luminance levels in the vertical scan direction can be calculated. Here, by allotting a luminance of 500 cd/m$^2$ to 255 gradation, a brilliancy of 300 cd/m$^2$ to 200 gradation and a brilliancy of 0.1 cd/m$^2$ to 0 gradation in advance, detection of a spatial distribution of maximum luminance levels in the vertical scan direction has been completed.

On the basis of the detection result of the maximum luminance distribution detecting circuit 201, the illumination light source luminance setting circuit 202 sets illumination light source luminance levels of the individual partitive areas of the lighting unit divided into the 8 partitive areas. For the luminance levels of the illumination light sources, PWM is used to control the luminance in accordance with the lighting period during one frame period and in the present embodiment, 16 setting values ranging from a lower luminance setting value to a higher luminance setting value are used.

Figure 37:
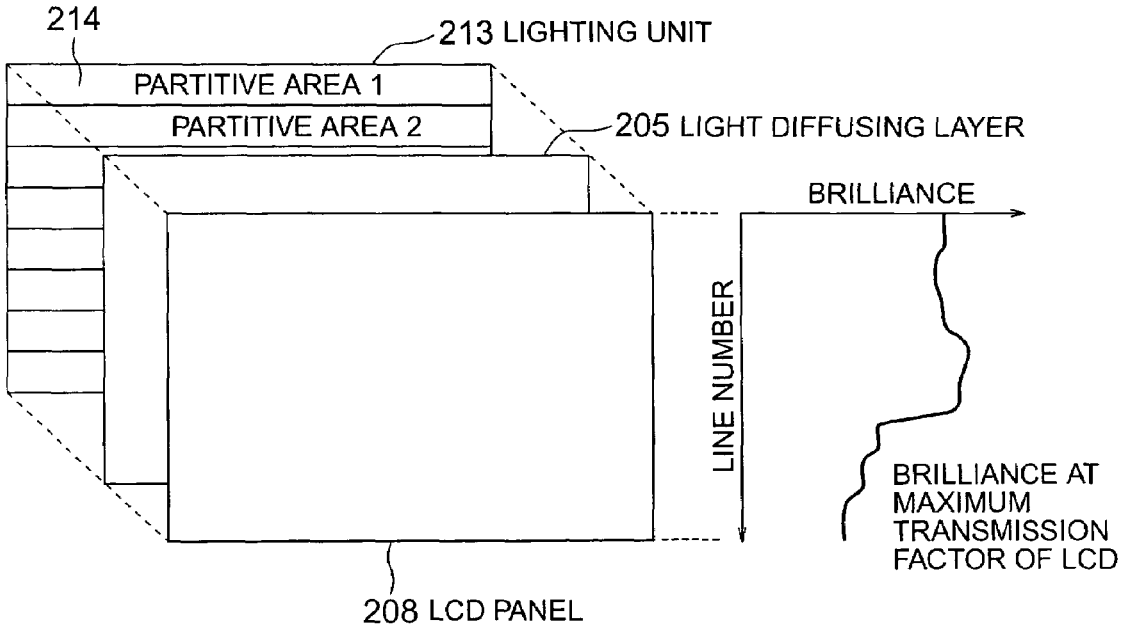
FIG. 37 is a diagram showing the relation between maximum luminance of video signal and maximum luminance the LCD can display.

On the basis of the luminance setting values of the individual partitive-area light sources set by the illumination light source luminance setting circuit 202, the light diffusing layer luminance distribution calculating circuit 206 calculates a luminance distribution on the light diffusing layer 205. In FIG. 37, there are illustrated, in relation to the illumination light source luminance levels set in respect of the individual partitive areas, luminance levels given by the product of the luminance levels on the light diffusing layer 205 and the maximum transmission factor of the LCD, that is, maximum luminance levels capable of being displayed on the LCD by the set illumination light source luminance levels of the individual partitive areas. If the maximum luminance levels capable of being displayed on the LCD are higher than the maximum luminance levels on the individual lines calculated by the maximum luminance distribution detecting circuit 201 on the individual lines, the luminance levels of the illumination light sources are sufficient.

The illumination light source luminance setting circuit 202 sequentially compares the calculation results by the light diffusing layer luminance distribution calculating circuit 206 with the detection results by the maximum luminance distribution detecting circuit 201 to perform setting of illumination light source luminance levels of the individual partitive areas which are necessary, at the least, for the luminance on the light diffusing layer to display the maximum luminance level of the video signal on each line.

On the basis of the setting values by the illumination light source luminance setting circuit 202, the illumination light source luminance control circuit 204 controls the lighting periods for the illumination light sources of individual partitive areas.

On the basis of the luminance on light diffusing layer 205 in register with each line, the video signal correction means 207 controls the transmission factor, that is, corrects the video signal such that the display luminance indicated by the video signal can be obtained.

As described above, according to the present embodiment, the display processing circuit 300 for controlling the video luminance and light source luminance detects the maximum luminance on each line in respect of all lines to calculate the maximum luminance distribution for one screen. Further, since the luminance of each partitive area of the lighting unit is set on the basis of the maximum luminance distribution for one screen, luminance setting is possible which respects an interaction between the individual partitive areas. In addition, it is possible to reproduce the original picture by subtracting the luminance of the lighting unit area by area.

For calculating the light diffusing layer luminance distribution from the illumination light source luminance setting in respect of the individual areas, reading of video signals for one frame is necessary and therefore, the video signals are stored in the frame memory 200 and are read out of the frame memory 200 at the next frame so that correction of the video signals and their delivery to the LCD may be carried out.

Embodiment 7

Figure 38:
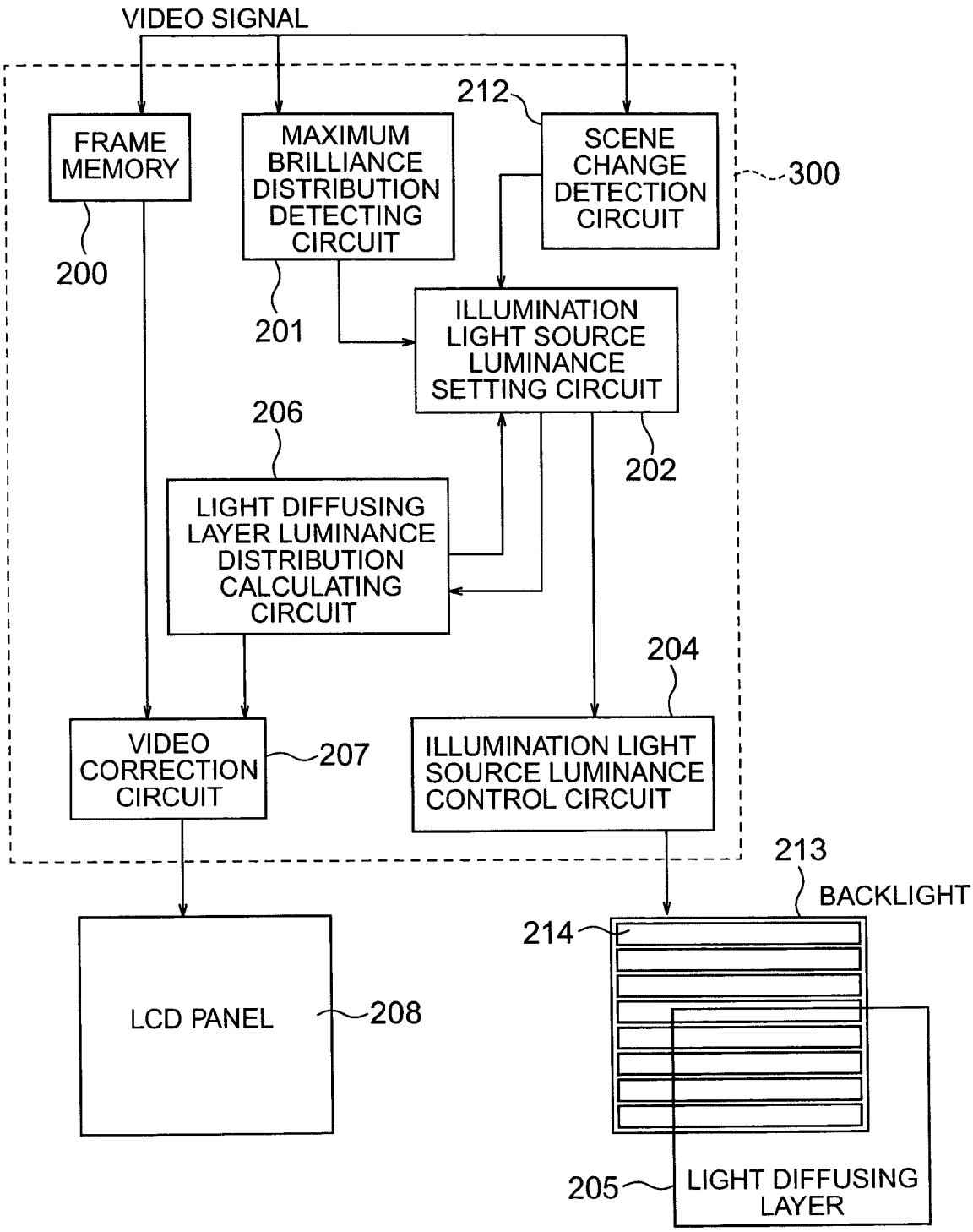
FIG. 38 is a block diagram showing an example of the video display apparatus according to the invention.

Embodiment 7 of this invention will now be described. The present embodiment is constructed as illustrated in FIG. 38. The construction of the present embodiment is similar to that of embodiment 6 with only exception that a display processing circuit 301 has a scene change detection circuit 212.

As described in connection with embodiment 6, the illumination light source luminance setting circuit 202 calculates the light source luminance setting value of each partitive area on the basis of the maximum luminance distribution of video signal and the diffusing layer luminance distribution. But in displaying a motion picture, the maximum luminance distribution of video signal changes momentarily and the illumination light source luminance of each partitive area also changes concomitantly. Under the circumstances, there arises a problem that when the light source changes greatly in luminance, a flicker takes place. Causes of generation of the flicker will be described below.

In the present embodiment, the light source luminance is controlled on the basis of a lighting period in one frame. Namely, the lighting luminance of light source is constant and hence, the lighting period during one frame is prolonged to obtain a high luminance level and is shortened to obtain a low luminance level. Displaying a background unchangeable in its display luminance in a picture of the same scene will now be considered.

Figure 39A:
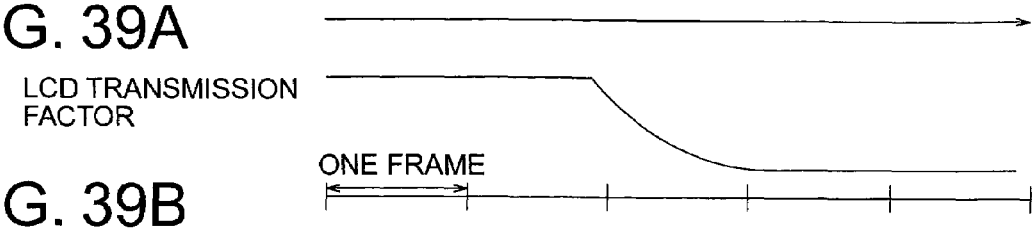
FIGS. 39A to 39C are diagrams for explaining causes of generation of a flicker.
Figure 39B:
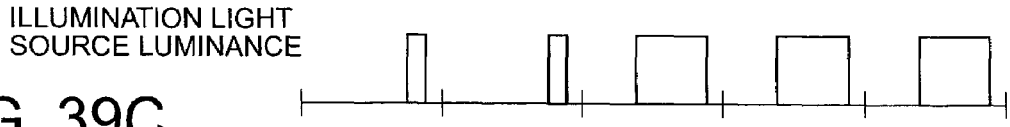
Figure 39C:
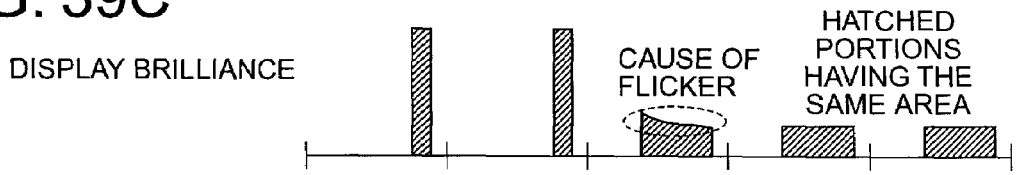

How a transmission factor waveform of LCD, a luminance waveform of illumination light source and a display luminance waveform are related to each other when the background luminance whose display luminance does not change is illustrated in FIGS. 39A to 39C. It is now supposed that a bright portion develops in a picture other than the background in a frame and the luminance of illumination light source changes abruptly. At that time, the illumination light source prolongs the lighting period during one frame in order to increase its luminance whereas the LCD responds to the increased luminance of illumination light source to reduce the transmission factor in order to keep the display luminance unchanged. But the transmission factor response of LCD requires a time of several ms to ten and several ms and so the illumination light source is lit before the target transmission factor is reached, with the result that the display luminance of the background is raised.

The display luminance can be expressed by the product of lighting luminance and its lighting period. A hatched area shown in FIG. 39C rightly corresponds to the product of the lighting luminance when the background luminance is displayed and its lighting period. In a frame in which the luminance of illumination light source increases abruptly, the display luminance waveform protrudes from the hatched area, thus causing a flicker.

In order to eliminate the flicker, suppression of the abrupt change in luminance of the illumination light source is effective. Then, in the illumination light source luminance setting circuit 202, the setting value used in the previous frame is stored and compared with a setting value calculated from the present frame, a change permissible value from the setting value of the previous frame is set and the illumination light source luminance of each partitive area used for the present frame is reset such that it can approximate, within the change permissible value, a setting value calculated in the present frame from the setting value used in the previous frame, thereby suppressing the abrupt luminance change.

Figure 40A:
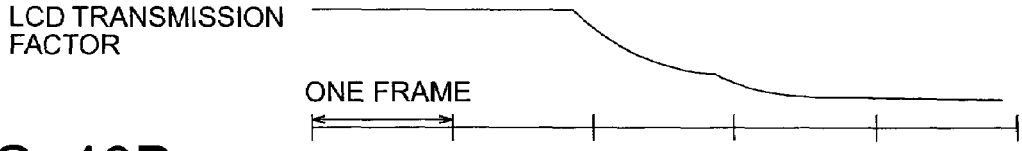
FIGS. 40A to 40C are diagrams for explaining a method for reduction of the flicker.
Figure 40B:
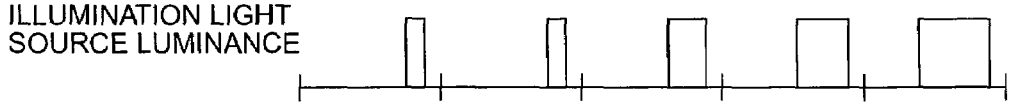
Figure 40C:
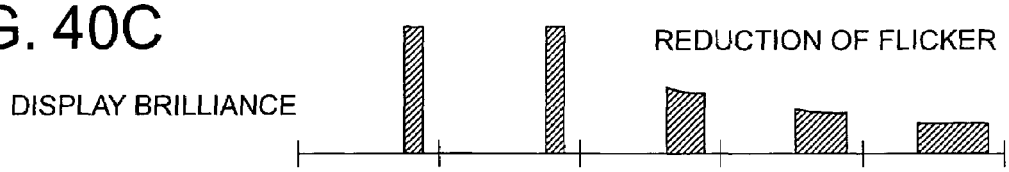

Referring now to FIGS. 40A to 40C, there is illustrated how a transmission factor waveform of LCD, a luminance waveform of illumination light source and a display luminance waveform are related to each other when the illumination light source luminance setting value change is carried out frame by frame by respecting the permissible change value. The setting value used for the previous frame is compared with the setting value calculated in the present frame and when the setting value calculated in the present frame is larger, the setting value is decreased in the permissible change value range. Contrarily, when the setting value used for the previous frame is larger than the setting value calculated in the present frame, the setting value is increased in the permissible change value range. Needless to say, when the setting value calculated in the present frame is equal to the setting value used for the previous frame, the setting value is not changed.

As described above, the illumination light source luminance setting circuit 202 does not use directly the setting value calculated on the basis of the detection result by the maximum luminance distribution detecting circuit 201 but does resetting of the setting value used for the present frame within the permissible change value through the comparison with the setting value used in the previous frame and as a result, the flicker in the same scene can be prevented.

More preferably, when the scene changes, switchover to the setting value calculated by the illumination light source luminance setting circuit 202 can be done quickly. Accordingly, the scene change detection circuit 212 is introduced in order that the flicker can be prevented while making the permissible change value of illumination light source luminance setting value small when the scene does not change but when the scene changes, the permissible change value of illumination light source luminance setting value is increased in conformity with the magnitude of the change to permit quick switchover of the illumination light source luminance, thereby ensuring that illumination light source luminance control devoid of a sense of incongruity can be executed.

The scene change detection circuit 212 prepares a histogram of a picture over the entire screen frame by frame, calculates a difference in histogram between frames and decides the magnitude of the difference.

Figure 41A:
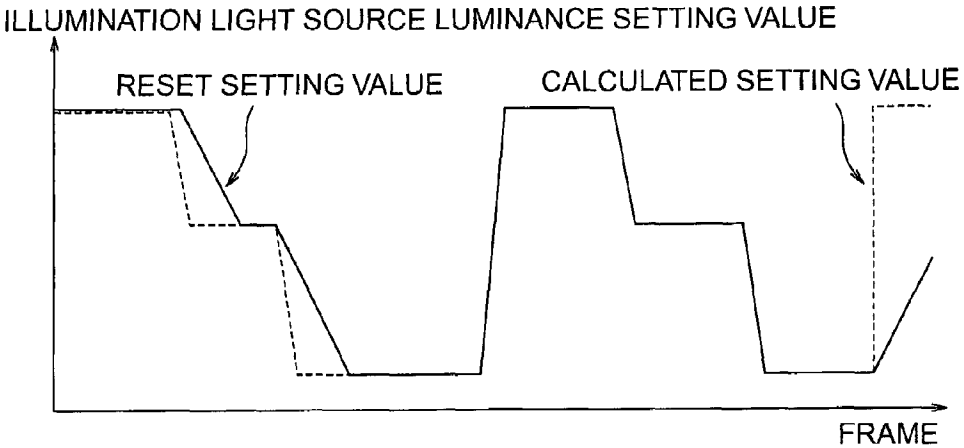
FIGS. 41A and 41B are graphic representations showing an inter-frame histogram difference amount and an inter-frame change amount of illumination light source luminance setting value.
Figure 41B:
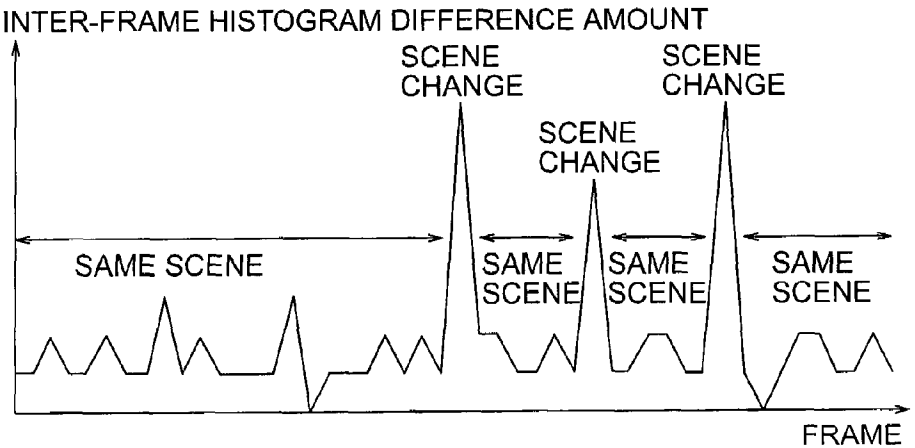

How the setting value calculated by the illumination light source luminance setting circuit 202, the reset setting value and the inter-frame histogram difference, that is, the state of scene change detection circuit 212 are related to each other is illustrated in FIGS. 41A and 41B. The resetting is such that when the inter-frame histogram difference is small, the same scene is determined to cause the reset setting value to gradually approach the setting value calculated by the illumination light source luminance setting circuit 202 but when the inter-frame histogram difference is large, a scene change is determined to cause the reset setting value to quickly approach the calculated value.

Embodiment 8

Figure 42:
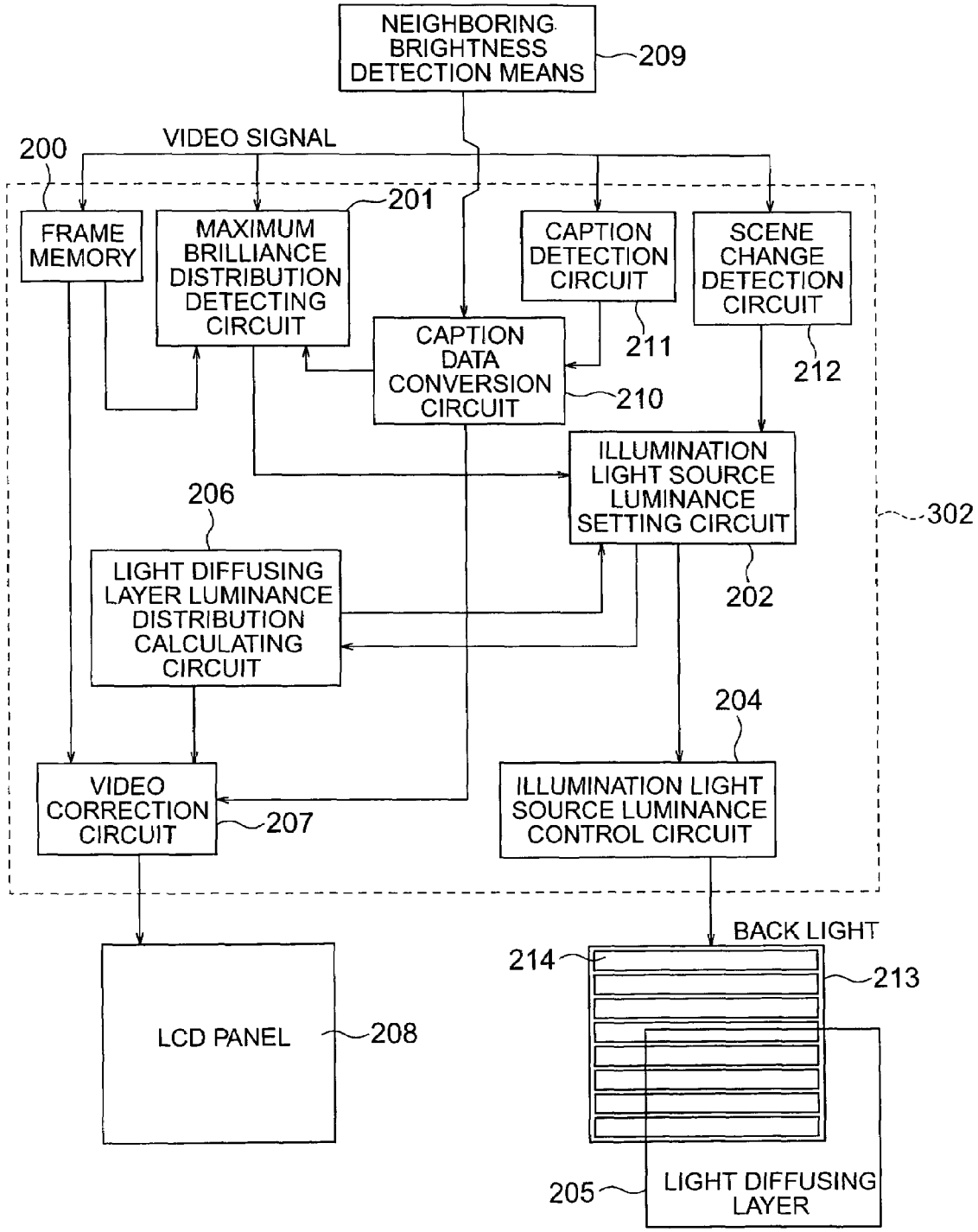
FIG. 42 is a block diagram showing an example of the video display apparatus according to the invention.

Embodiment 8 of the invention will be described. The present embodiment is constructed as illustrated in block form in FIG. 42. The present embodiment is similar to embodiment 7 with the exception that a neighborhood ambient light detection means 209 for detecting the ambient light of the neighborhood of the video display apparatus is provided and a display processing circuit 302 includes a caption detection circuit 211 and a caption data conversion circuit 210.

The present embodiment aims at reducing power consumption by reducing the luminance of illumination light source through suitable reduction of display luminance of captions.

In appreciating a movie through the medium of a DVD (digital versatile disk), captions often develop on the screen. Frequently, a caption is of white color of 255 gradation and for the sake of displaying the caption, the illumination light source must be lit at the maximum luminance.

But depending on the ambient light of the neighborhood, the caption of 255 gradation luminance gives a dazzling feel to persons in some case and therefore an easy-to-watch feeling can be promoted and besides consumptive power can be reduced by decreasing, rather, the luminance of the caption suitably.

The present embodiment includes the neighborhood ambient light detection means 209 for detecting the ambient light of the neighborhood, the caption detection circuit 211 for detecting a signal corresponding to a caption from a video signal and the caption data conversion circuit 210 for converting the video signal corresponding to the caption detected by the caption detection circuit 211. A method for control in the present embodiment will be described hereunder.

Figure 43:
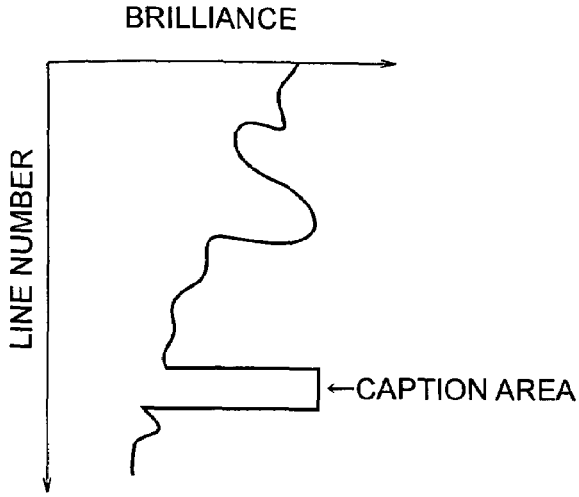
FIG. 43 is a graphic representation showing a video signal maximum luminance distribution before video data of a caption is changed.
Figure 44:
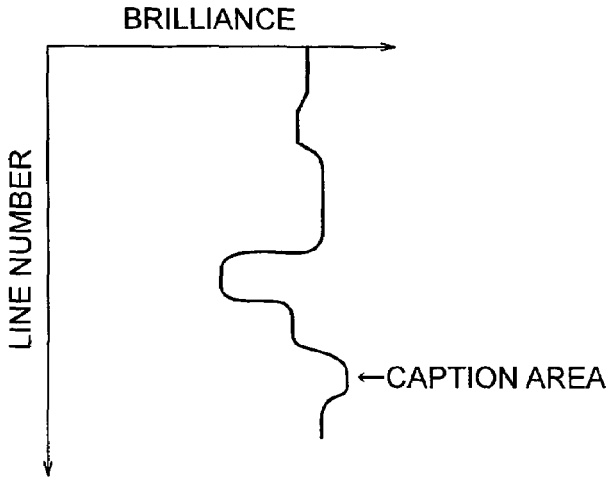
FIG. 44 is a graphic representation showing a maximum luminance capable of being displayed through illumination light source luminance setting before the video data of the caption is changed.
Figure 45:
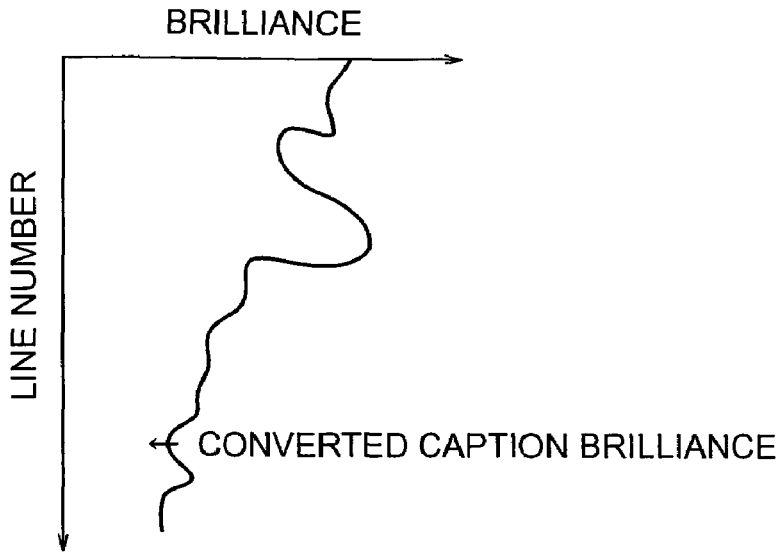
FIG. 45 is a graphic representation showing a video signal maximum luminance distribution after the video data of the caption is changed.
Figure 46:
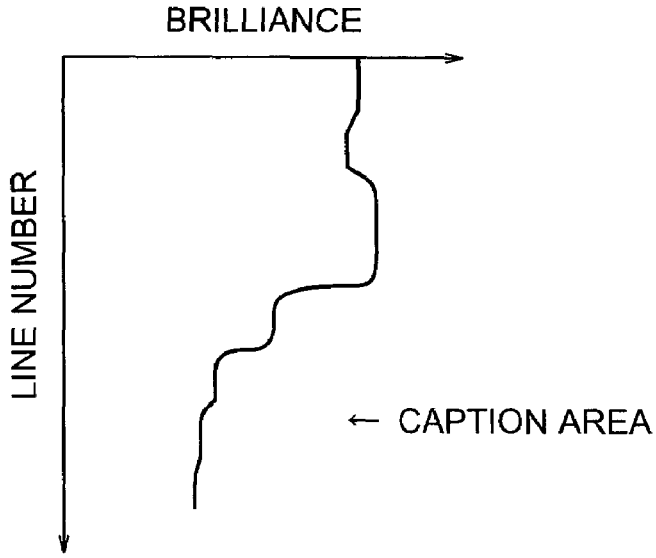
FIG. 46 is a graphic representation showing a maximum luminance capable of being displayed through illumination light source luminance setting after the video data of the caption is changed.

As described in connection with embodiment 7, the maximum luminance distribution detecting circuit 201 calculates the maximum luminance distribution in the vertical scan direction from the video signal. An example of maximum luminance distribution in the vertical scan direction calculated from a video signal containing a caption is graphically illustrated in FIG. 43. An area in which the caption develops exhibits a maximum display luminance. When luminance levels of the individual partitive areas are set from this maximum luminance distribution, a maximum luminance distribution capable of being displayed on the LCD with the illumination light source luminance levels is depicted in FIG. 44, demonstrating that the luminance of illumination light source is raised near the area at which the caption is displayed. When the caption detection circuit 211 detects a caption, the caption data conversion circuit 210 changes a video signal of caption of 255 gradation on the basis of a detection result by the neighborhood ambient light detection means 209. For example, when the ambient light of the neighborhood is 150 lx (lux), a change to 200 gradation is done and when the ambient light of the neighborhood is 10 lx, a change to 128 gradation is done. In this manner, as the neighborhood becomes darker, a change to lower gradation is done. After the video signal of caption is changed, a video signal on a line for the area in which the caption develops is read out of the frame memory 200 and is again inputted to the maximum luminance distribution detecting circuit to modify the maximum luminance distribution. The modified maximum luminance distribution is illustrated in FIG. 45. In the figure, the video signal of caption is changed to 128 gradation. A maximum luminance distribution capable of being displayed on the LCD when the illumination light source luminance levels of the individual partitive areas are set from the modified maximum luminance distribution is illustrated in FIG. 46. As described above, by detecting the caption and changing the video signal of caption in accordance with the ambient light of the neighborhood, the luminance level of the illumination light source area at which the caption develops can be reduced.

Embodiment 9

Figure 47:
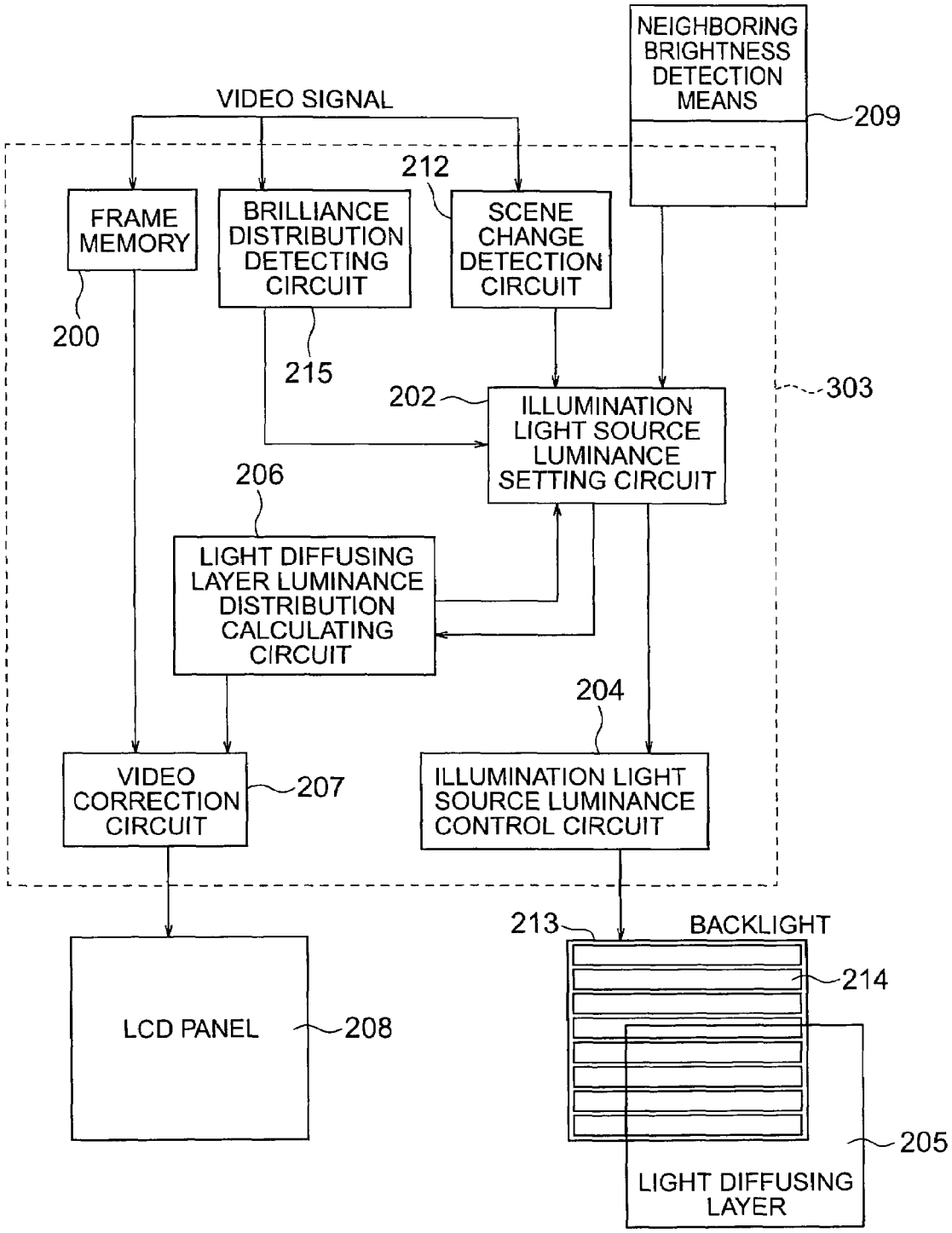
FIG. 47 is a block diagram showing an example of the video display apparatus according to the invention.

Embodiment 9 of this invention will be described. The present embodiment is constructed as illustrated in block form in FIG. 47. Structurally, the present embodiment is similar to embodiment 7 with the exception that the maximum luminance distribution detecting circuit 201 is changed to a luminance distribution detecting circuit 215 and a neighborhood ambient light detection means 209 is added.

The luminance distribution detecting circuit 215 counts the number of pixels being on each line of LCD panel 208 and exhibiting individual luminance levels from a video signal on each line. For example, the number of pixels exhibiting individual luminance levels is counted in such a manner that on the first line, there are 10 pixels exhibiting a luminance level of 500 cd/m$^2$ and 100 pixels exhibiting a luminance level of 50 cd/m$^2$. By performing this operation for all lines, a distribution situation of luminance in the vertical scan direction can be detected.

Figure 48A:
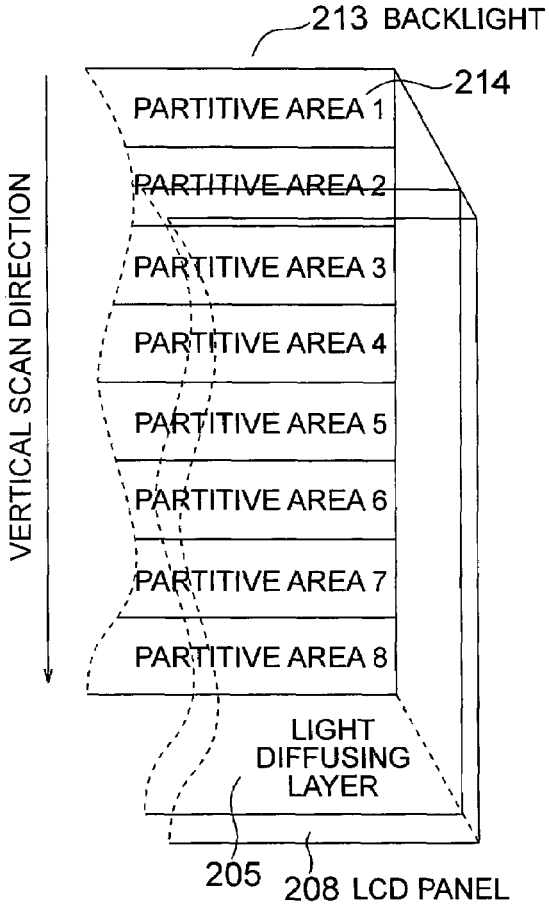
FIGS. 48A and 48B are diagrams for explaining a luminance distribution calculating circuit.
Figure 48B:
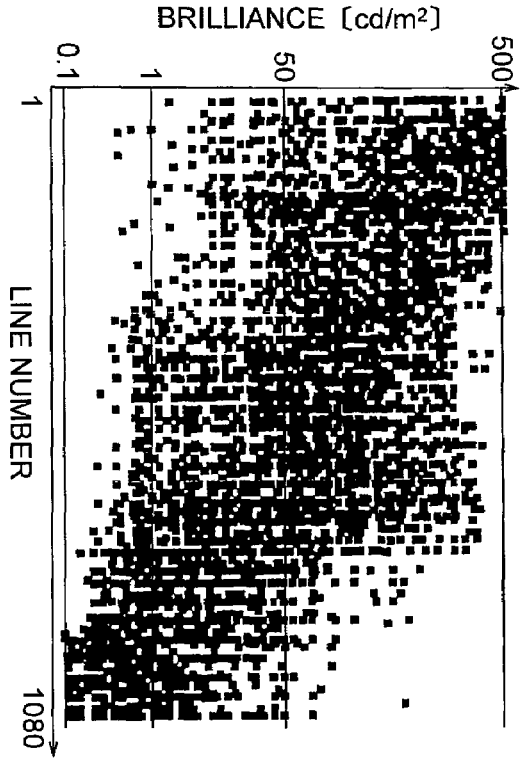

A luminance distribution in the vertical scan direction obtained by the luminance distribution detecting circuit 215 is illustrated in FIGS. 48A and 48B. A corresponding number of pixels exhibiting individual luminance levels on each line are plotted. By conducting the detection as above, not only the maximum luminance and the minimum luminance on each line but also information concerning an area to which bright videos are concentrated, an area to which medium bright videos are concentrated and an area to which dark videos are concentrated can be read. In the example shown in FIGS. 48A and 38B, bright videos are concentrated to an upper part of the screen, medium ambient light is concentrated to the screen center and its vicinity and dark videos are concentrated to a lower screen part and its vicinity.

The illumination light source luminance setting circuit 202 sets luminance levels of the individual illumination light source areas on the basis of the information from the luminance distribution detecting circuit 215 and neighboring ambient light detection means 209. A method for illumination light source luminance setting will be detailed below.

Figure 49:
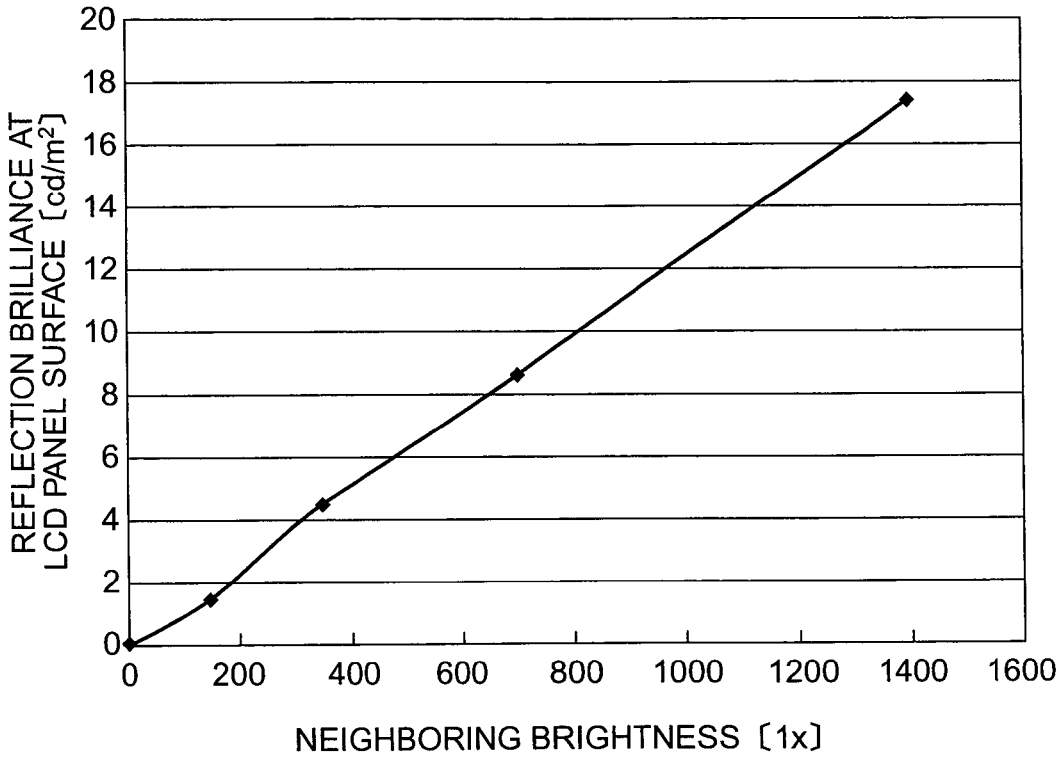
FIG. 49 is a graph showing the neighboring ambient light and the surface reflection luminance of an LCD panel.

Here, the relation between ambient light of the neighborhood of video display apparatus and display dynamic range will be described. In many cases, the display surface of LCD panel 208 is applied with reflection preventive working and is so treated as not to reflect neighboring light as much as possible. But, complete elimination of reflection is difficult to achieve and the display surface becomes slightly bright. The present inventors have prepared a LCD panel 208 and measured the relation between neighboring ambient light and surface reflection luminance of the LCD panel 208 when the illumination light source is not lit to obtain a result graphically illustrated in FIG. 49. As the neighboring ambient light increases, the luminance of the surface of LCD panel 208 rises. A picture to be displayed on the LCD panel 208 and having a luminance level lower than the reflection luminance is so affected by the reflection luminance as to degrade the resolution of luminance perceivable by human eyes and is hardly visualized. In other words, as the neighboring ambient light rises, the display dynamic range of LCD is narrowed.

Figure 50:
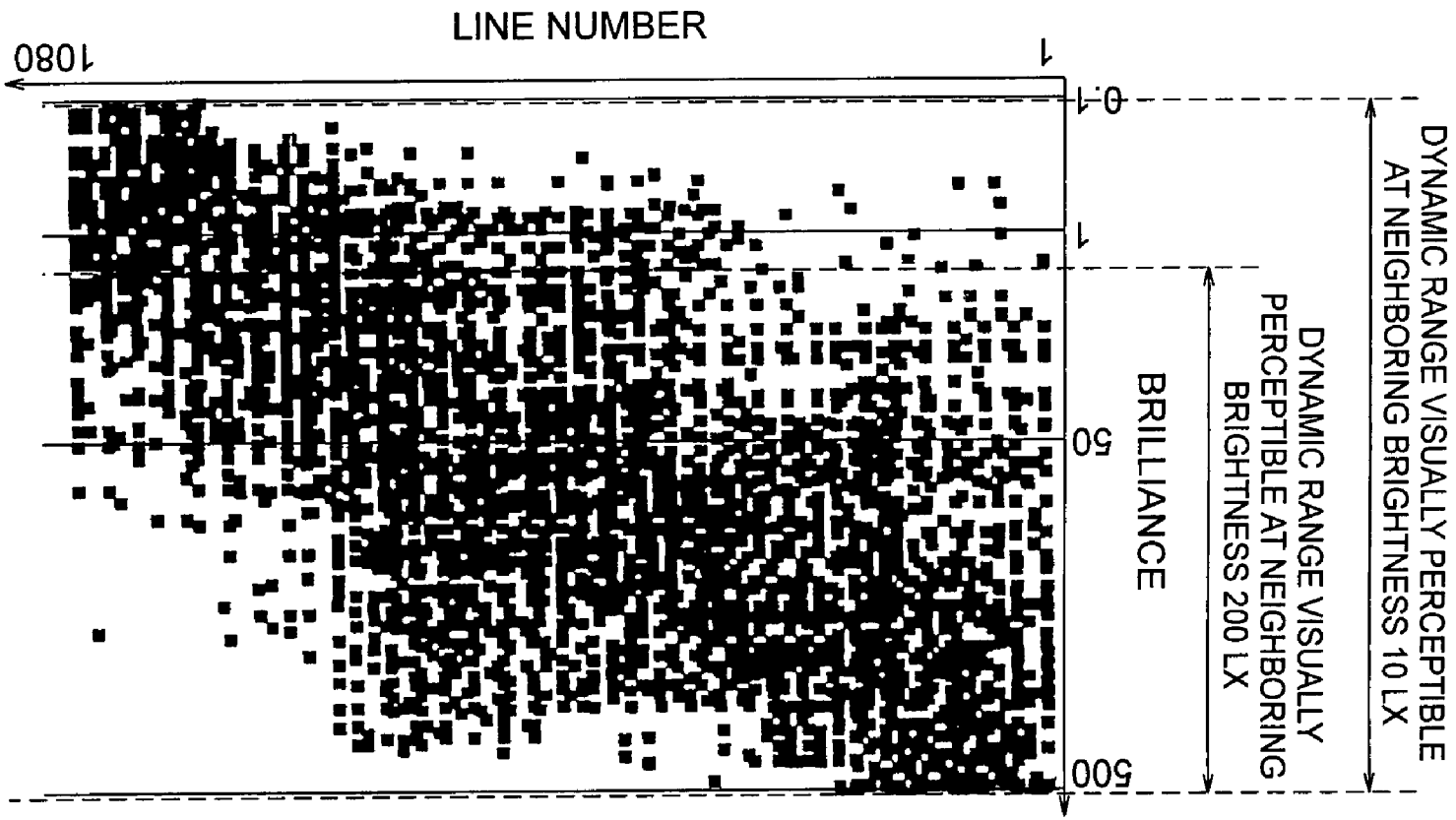
FIG. 50 is a diagram showing the relation between visually perceptible dynamic range and video signal luminance distribution.

How the dynamic range visually perceptible on the LCD is related to the luminance distribution for each line detected by the luminance distribution detecting circuit 215 and the neighboring ambient light is illustrated in FIG. 50. The visually perceptible display dynamic range is relatively narrow amounting to 2 cd/m$^2$ to 500 cd/m$^2$ when the neighboring ambient light is 200 lx but is wide amounting to 0.1 cd/m$^2$ to 500 cd/m$^2$ when the neighboring ambient light is 10 lx. Therefore, the LCD used herein has a contrast ratio of 500:1. In other words, when the maximum luminance to be displayed is 500 cd/m$^2$, the lowest luminance is 1 cd/m$^2$ and in order to display a luminance level of 1 cd/m$^2$ or less, the illumination light source needs to be modulated in luminance.

The illumination light source luminance setting circuit 202 determines a visually perceptible dynamic range from the result of detection by the neighboring luminance detection circuit 209 and sets illumination light source luminance levels of the individual partitive areas on the basis of information of luminance distribution for each line. A method for setting the luminance of illumination light source will be described for the cases of 200 lx and 10 lx neighboring ambient light levels, respectively.

Figure 51:
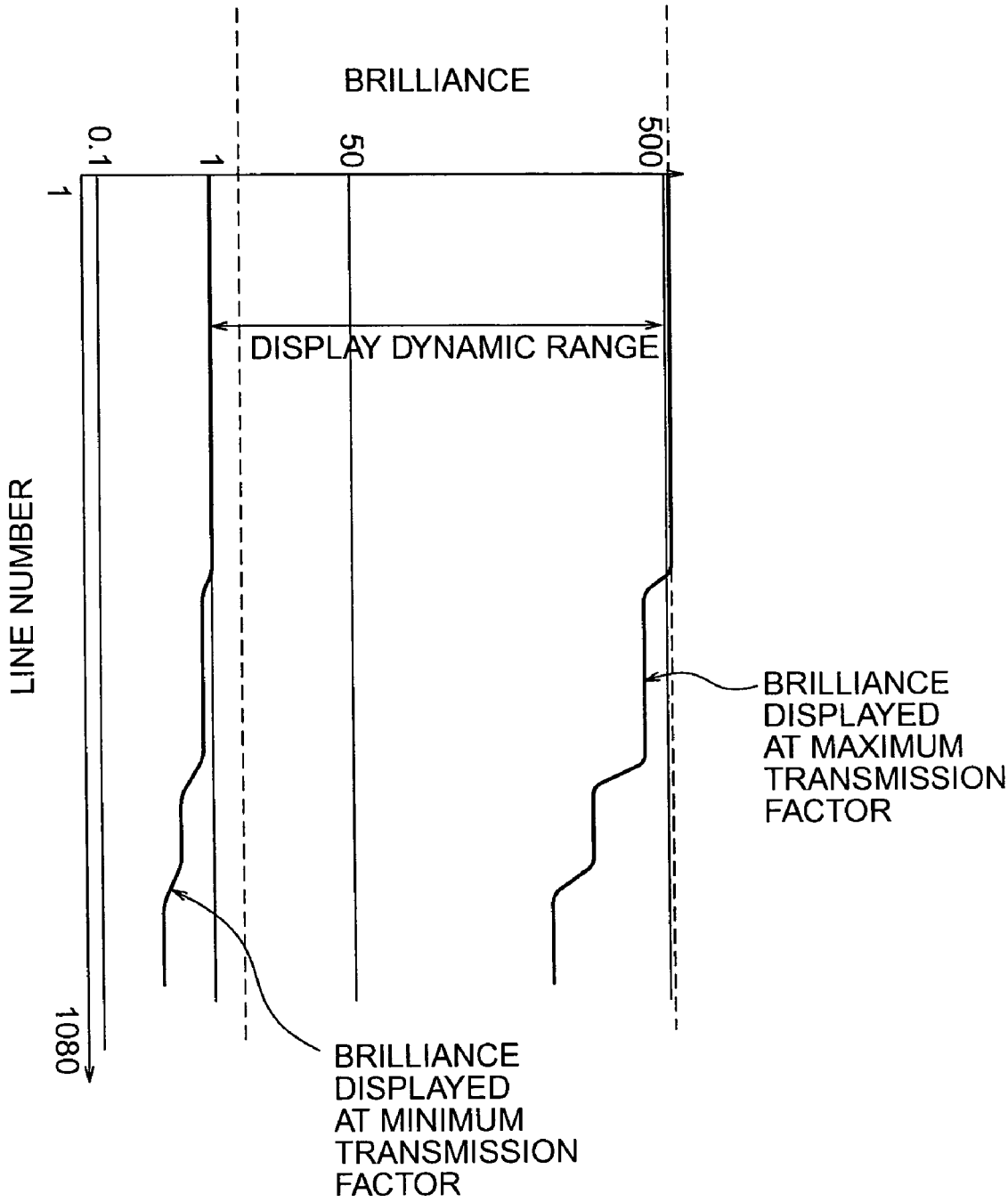
FIG. 51 is a diagram showing the display dynamic range after illumination light source luminance setting is done.

Firstly, the case of the neighboring ambient light being 200 lx will be considered. In this case, the range of luminance to be displayed is from 2 cd/m$^2$ to 500 cd/m$^2$, which range is narrower than the dynamic range of LCD of from 1 cd/m$^2$ to 500 cd/m$^2$ when the illumination light source is lit at the maximum luminance. Accordingly, luminance levels of the individual illumination light source partitive areas may be set such that the maximum luminance on each line can be displayed. When the luminance levels of illumination light sources of the individual partitive areas are set such that the maximum luminance on each line can be displayed, a luminance level displayed at the maximum transmission factor of the LCD and a luminance level displayed at the lowest luminance of the LCD, that is, a display dynamic range is illustrated in FIG. 51. It will be seen from the figure that all luminance levels visually perceptible at the 200 lx neighboring ambient light can be confined in the display dynamic range and the luminance of illumination light source can be reduced.

Next, the case of the neighboring ambient light being 10 lx will be considered. In this case, the lowest luminance to be displayed is 0.1 cd/m$^2$ and when the illumination light source luminance levels of the individual partitive areas are set such that the maximum luminance on each line can be displayed, the lowest luminance cannot be displayed correctly in some case. For example, by making reference to the dynamic range in FIG. 51 which can be displayed when the illumination light source luminance levels of the individual partitive areas are set such that the maximum luminance on each line can be displayed, it will be seen that the lowest luminance capable of being displayed is larger than 0.1 cd/m$^2$. Consequently, many pixels exhibiting 0.1 cd/m$^2$ which exist near the lowest 1080-th line in FIG. 50 cannot be displayed correctly. As will be seen from the above, when the neighboring ambient light is dark and the visually perceptible dynamic range is wide, the illumination light source luminance setting for each partitive area based on only the maximum luminance on each line is sometimes insufficient.

The luminance distribution detection circuit 215 is a circuit adapted to eliminate the above problem. More specifically, the luminance distribution detection circuit 215 can know the number of pixels on each line exhibiting luminance levels in accordance with their corresponding luminance levels and therefore, setting of the luminance of illumination light source can be set such that a larger number of pixels can be fetched into the display dynamic range.

More particularly, a permissible number of pixels are excluded from the dynamic range on each line in sequence of pixels exhibiting higher luminance levels to reduce the luminance of illumination light source correspondingly and pixels exhibiting lower luminance levels are fetched into the dynamic range. Of course, the permissible number of pixels is so small that the display picture will not be degraded extremely. At that time, if the permissible number of pixels is changed in accordance with a result of detection by the neighboring ambient light detection means 209 or a luminance distribution condition on each line, more efficient results can be obtained. Specifically, the permissible pixel number is increased when the neighboring ambient light is dark and the luminance distribution on each line is concentrated on lower luminance levels but the permissible pixel number is decreased when the neighboring ambient light is bright and the luminance distribution is concentrated on brighter luminance levels, thus making it possible to obtain optimum illumination light source luminance setting.

Figure 52:
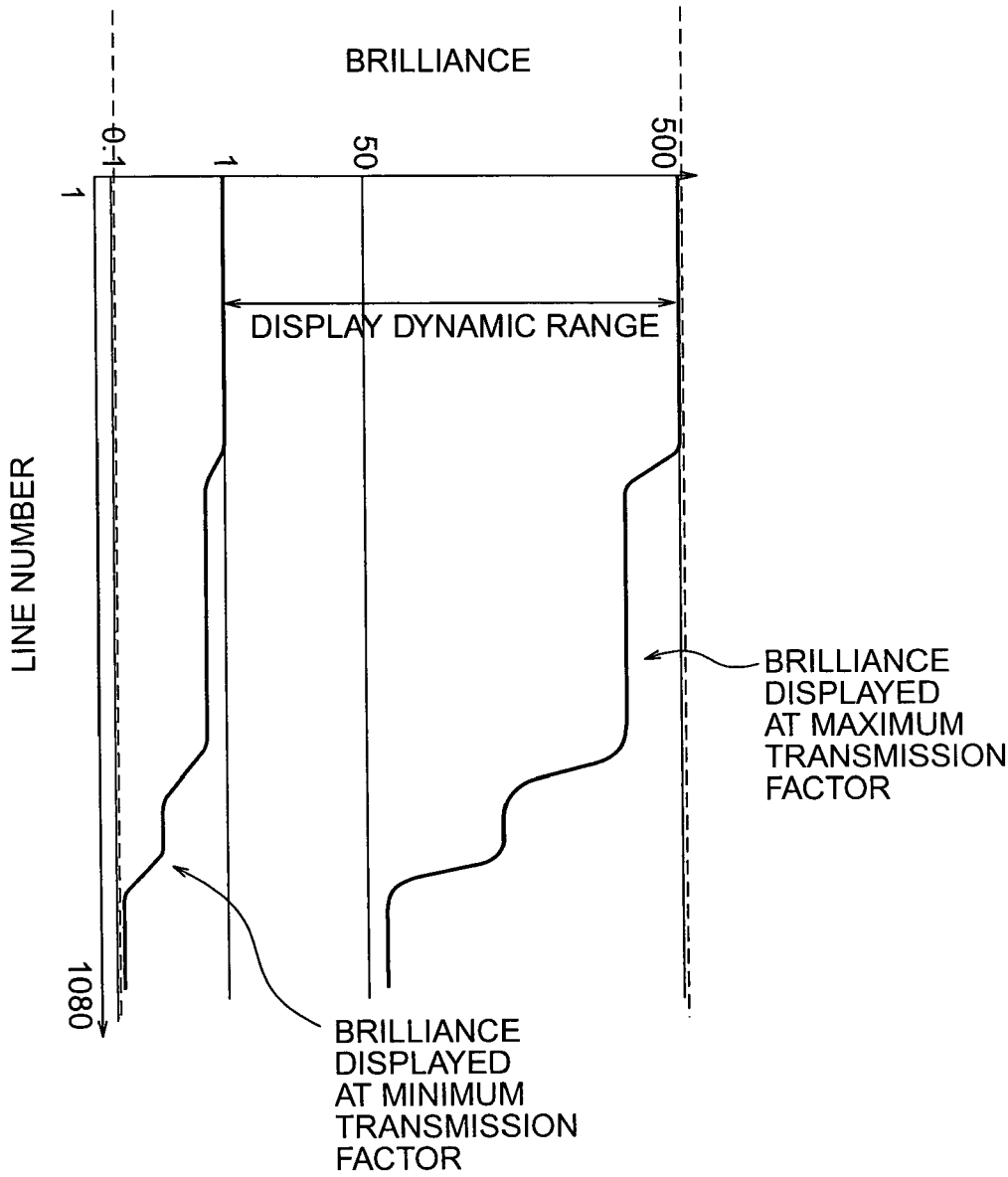
FIG. 52 is a diagram showing the display dynamic range after the illumination light source luminance setting is done.

A luminance level displayed at the maximum transmission factor of the LCD and a luminance level displayed at the lowest luminance of the LCD, that is, a display dynamic range can be obtained as shown in FIG. 52 when luminance levels of illumination light sources of the individual partitive areas are set such that a larger number of pixels exhibiting lower luminance levels can be fetched to the dynamic range by permitting two pixels counted from a pixel on each line exhibiting the maximum luminance to provide a luminance distribution and excluding the luminance distribution from the dynamic range suitably. As a result, the lowest 0.1 cd/m$^2$ luminance level can be displayed to improve the display characteristic substantially to a contrast of 5000:1.

As described above, in the present embodiment, the luminance distribution on each horizontal scan line is detected for all lines to detect the luminance distribution for one screen. In this manner, the luminance distribution condition in the vertical scan direction is detected.

The foregoing description is given on the presupposition that the maximum luminance is set to 500 cd/m$^2$ but obviously, the absolute value of luminance of the illumination light source can be reduced in accordance with the neighboring ambient light.

The luminance distribution detecting circuit 215 detects the luminance distribution line by line but the detection for one line is not limitative and plural lines may be used for this purpose, permitting the number of lines corresponding to the number of illumination light source partitive areas at the most to be used for this purpose.

In the present embodiment, the illumination light source is divided into 8 in the vertical scan direction but by making the division finer, a picture of higher picture quality can be displayed.

Embodiment 10

Embodiment 10 of the present invention will be described. In the construction used for embodiment 9, the caption detection circuit 211 and caption data conversion circuit 210 explained in connection with embodiment 8 can be introduced easily.

Figure 53:
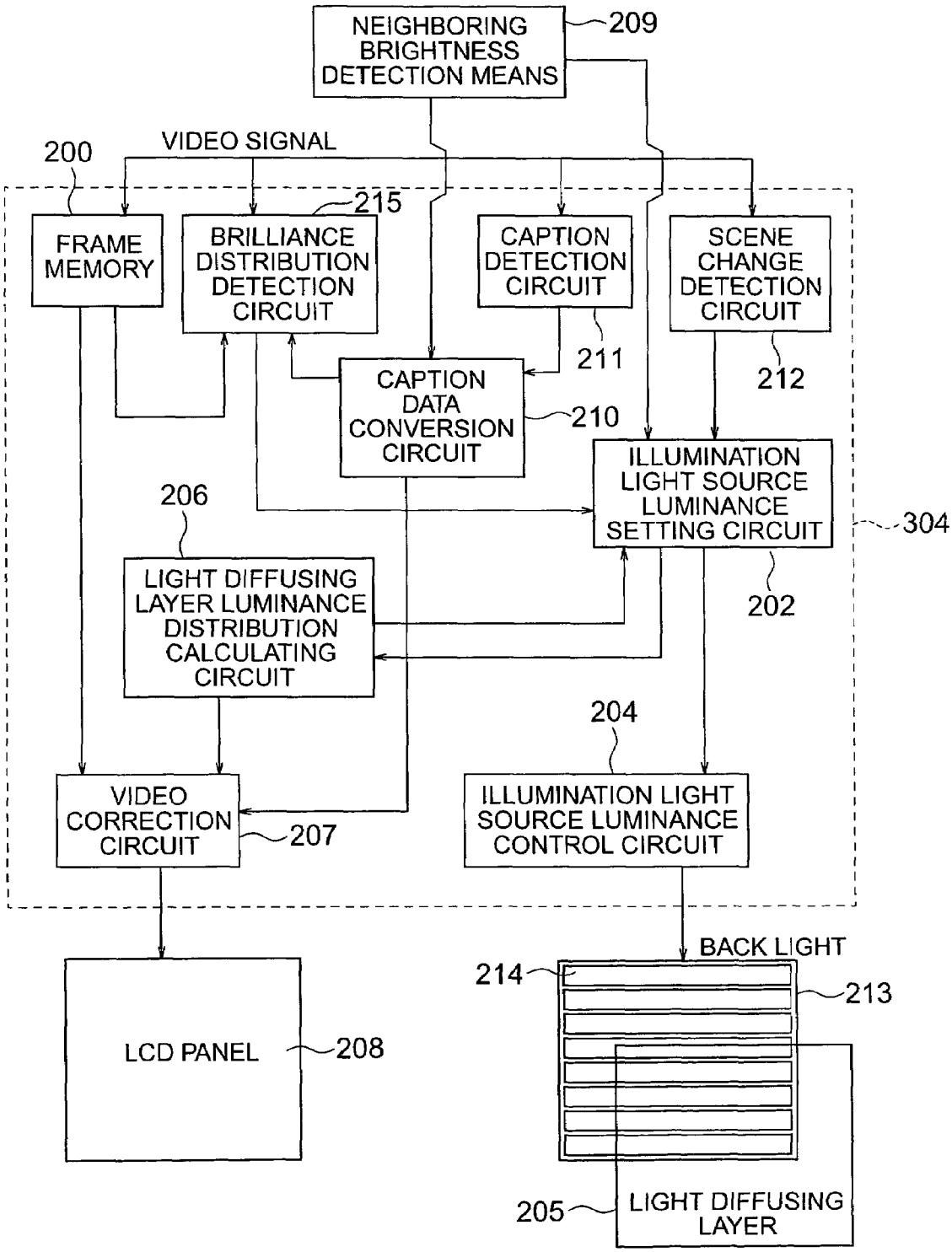
FIG. 53 is a block diagram showing an example of the video display apparatus according to the invention.

The present embodiment is constructed as illustrated in block form in FIG. 53. In the construction of embodiment 10, the caption detection circuit 211 and caption data conversion circuit 210 are added to the construction of embodiment 9.

The caption detection circuit 211 detects a video signal corresponding to a caption from a video signal and the caption data conversion circuit 210 changes suitably the video signal corresponding to the detected caption on the basis of the result of detection by the neighboring ambient light detection means 209, reads again the video signal for the line on which the caption develops from the frame memory 200 and inputs it to the luminance distribution detecting circuit 215. The luminance distribution detecting circuit 215 recalculates a luminance distribution for the line on which the caption develops and after the change of the video signal corresponding to the caption and modifies luminance distribution information of the whole screen. The thus modified luminance distribution information is sent to the illumination light source luminance setting circuit 202. The method of setting illumination light source luminance levels of the individual partitive areas by means of the illumination light source luminance setting circuit 202 is similar to that explained in connection with embodiment 9.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A video display apparatus having a light modulation device for forming a picture in accordance with a video signal, a lighting unit for irradiating, on said light modulation device, illumination light necessary to cause it to display the picture, and a light diffusing layer for diffusing the illumination light from said lighting unit, said lighting unit being divided into n light source partitive areas which are controllable in luminance individually, said apparatus comprising:

a maximum luminance distribution detecting circuit for calculating a maximum luminance distribution on the screen from video signals;

an illumination light source luminance setting circuit for setting illumination luminance levels of said individual illumination light source partitive areas on the basis of the result of calculation by said maximum luminance distribution detection circuit;

an illumination light source luminance control circuit for controlling the luminance levels of said individual illumination light source partitive areas on the basis of illumination light source luminance setting values of said individual partitive areas set by said illumination light source luminance setting circuit;

a light diffusing layer luminance distribution calculating circuit for calculating a luminance distribution on said light diffusing layer on the basis of the illumination light source luminance setting values of said individual partitive areas set by said illumination light source luminance setting circuit; and video signal correction means for correcting the video signal on the basis of the result of luminance calculation by said light diffusing layer luminance distribution calculating circuit.

2. A video display apparatus according to claim 1 further comprising a scene change detection circuit for detecting from a video signal a switchover of picture scene, wherein said illumination light source luminance setting circuit resets the illumination luminance setting values of said individual partitive areas on the basis of the result of detection by said scene change detection circuit, said illumination light source luminance control circuit controls luminance levels of said individual light source partitive areas on the basis of the illumination light source luminance setting values of said individual partitive areas reset by said illumination light source luminance setting circuit, said light diffusing layer luminance distribution calculating circuit calculates a luminance distribution on said light diffusing layer on the basis of the illumination light source luminance setting values reset by said illumination light source luminance setting circuit, and said video signal correction means corrects the video signals on the basis of the result of luminance calculation by said light diffusing layer luminance distribution calculating circuit.

3. A video display apparatus having a light modulation device for forming a picture in accordance with a video signal, a lighting unit for irradiating, on said light modulation device, illumination light necessary to cause it to display the picture and a light diffusing layer for diffusing the illumination light from said lighting unit, said lighting unit being divided into n light source partitive areas which are controllable in luminance individually, said apparatus comprising:

a caption detection circuit;

a caption data conversion circuit for suitably changing a video signal corresponding to a caption detected by said caption detection circuit;

a maximum luminance distribution detecting circuit for calculating a maximum luminance distribution on the screen from video signals;

an illumination light source luminance setting circuit for setting illumination luminance levels of said individual illumination light source partitive areas on the basis of the result of calculation by said maximum luminance distribution detecting circuit;

an illumination light source luminance control circuit for controlling the luminance levels of said individual illumination light source partitive areas on the basis of the illumination light source luminance setting values of said individual partitive areas set by said illumination light source luminance setting circuit;

a light diffusing layer luminance distribution calculating circuit for calculating a luminance distribution on said light diffusing layer on the basis of the illumination light source luminance setting values of said individual partitive areas set by said illumination light source luminance setting circuit; and video signal correction means for correcting the video signal on the basis of the result of luminance calculation by said light diffusing layer luminance distribution calculating circuit.

4. A video display apparatus according to claim 3 further comprising neighboring ambient light detection means for detecting ambient light of the neighborhood, wherein said caption data conversion circuit converts the video signal corresponding to the caption detected by said caption detection circuit on the basis of the result of detection by said neighboring ambient light detection means.

5. A video display apparatus having a light modulation device for forming a picture in accordance with a video signal, a lighting unit for irradiating, on said light modulation device, illumination light necessary to cause it to display the picture and a light diffusing layer for diffusing the illumination light from said lighting unit, said lighting unit being divided into n light source partitive areas which are controllable in luminance individually, said apparatus comprising:

a caption detection circuit;

a caption data conversion circuit for suitably changing a video signal corresponding to a caption detected by said caption detection circuit;

a maximum luminance distribution detecting circuit for calculating a maximum luminance distribution on the screen from video signals;

an illumination light source luminance setting circuit for setting illumination luminance levels of said individual illumination light source partitive areas on the basis of the result of calculation by said maximum luminance distribution detection circuit;

a scene change detection circuit for detecting from a video signal a switchover of picture scene, said illumination light source luminance setting circuit being operative to reset the illumination luminance setting values of said individual partitive areas on the basis of the result of detection by said scene change detection circuit;

an illumination light source luminance control circuit for controlling the illumination light source luminance setting values of said individual partitive areas on the basis of the illumination light source luminance setting values of said individual partitive areas reset by said illumination light source luminance setting circuit;

a light diffusing layer luminance calculating circuit for calculating a luminance distribution on said light diffusing layer on the basis of the illumination light source luminance setting values of said individual partitive areas reset by said illumination light source luminance setting circuit; and video signal correction means for correcting video signals on the basis of the result of luminance calculation by said light diffusing layer luminance distribution calculating circuit.

6. A video display apparatus having a light modulation device for forming a picture in accordance with a video signal, a lighting unit for irradiating, on said light modulation device, illumination light necessary to cause it to display the picture and a light diffusing layer for diffusing the illumination light from said lighting unit, said lighting unit being divided into n light source partitive areas which are controllable in luminance individually, said apparatus comprising:

a luminance distribution detection circuit for calculating a brilliancy distribution on the screen from video signals;

neighboring ambient light detection means for detecting ambient light of the neighborhood;

an illumination light source luminance setting circuit for setting illumination luminance levels of said individual illumination light source partitive areas on the basis of the result of calculation by said luminance distribution detection circuit and the result of detection by said neighboring ambient light detection means;

an illumination light source luminance control circuit for controlling the luminance levels of said individual illumination light source partitive areas on the basis of the illumination light source luminance setting values of said individual partitive areas set by said illumination light source luminance setting circuit;

a light diffusing layer luminance distribution calculating circuit for calculating a luminance distribution on said light diffusing layer on the basis of the illumination light source luminance setting values of said individual partitive areas set by said illumination light source luminance setting circuit; and video signal correction means for correcting video signals on the basis of the result of luminance calculation by said light diffusing layer luminance distribution calculating circuit.

7. A video display apparatus having a light modulation device for forming a picture in accordance with a video signal, a lighting unit for irradiating, on said light modulation device, illumination light necessary to cause it to display the picture and a light diffusing layer for diffusing the illumination light from said lighting unit, said lighting unit being divided into n light source partitive areas which are controllable in luminance individually, said apparatus comprising:

a luminance distribution detection circuit for calculating a luminance distribution on the screen from video signals;

neighboring ambient light detection means for detecting ambient light of the neighborhood;

an illumination light source luminance setting circuit for setting illumination luminance levels of said individual illumination light source partitive areas on the basis of the result of calculation by said luminance distribution detection circuit and the result of detection by said neighboring ambient light detection means;

a scene change detection circuit for detecting from a video signal a switchover of a picture scene, said illumination light source luminance setting circuit being operative to reset the illumination luminance setting values of said individual partitive areas on the basis of the result of detection by said scene change detection circuit;

an illumination light source luminance control circuit for controlling the luminance levels of said illumination light source partitive areas on the basis of the illumination light source luminance setting values of said individual partitive areas reset by said illumination light source luminance setting circuit;

a light diffusing layer luminance distribution calculating circuit for calculating a luminance distribution on said light diffusion layer on the basis of the illumination light source luminance setting values of said individual partitive areas reset by said illumination light source luminance setting circuit; and video signal correction means for correcting video signals on the basis of the result of luminance calculation by said light diffusing layer luminance distribution calculating circuit.

8. A video display apparatus having a light modulation device for forming a picture in accordance with a video signal, a lighting unit for irradiating, on said light modulation device, illumination light necessary to cause it to display the picture and a light diffusing layer for diffusing the illumination light from said lighting unit, said lighting unit being divided into n light source partitive areas which are controllable in luminance individually, said apparatus comprising:

a caption detection circuit;

a caption data conversion circuit for suitably changing a video signal corresponding to the caption detected by said caption detection circuit;

a neighboring ambient light detection circuit for detecting ambient light of the neighborhood;

a luminance distribution detection circuit for calculating a luminance distribution on the screen from video signals;

an illumination light source luminance setting circuit for setting illumination luminance levels of said individual illumination light source partitive areas on the basis of the result of calculation by said luminance distribution detection circuit and the result of detection by said neighboring ambient light detection circuit;

an illumination light luminance control circuit for controlling the luminance levels of said individual illumination light source partitive areas on the basis of the illumination light source luminance setting values of said individual partitive areas set by said illumination light source luminance setting circuit;

a light diffusing layer luminance distribution calculating circuit for calculating a luminance distribution on said light diffusing layer on the basis of the illumination light source luminance setting values of said individual partitive areas set by said illumination light source luminance setting circuit; and video signal correction means for correcting video signals on the basis of the result of luminance calculation by said light diffusing layer luminance distribution calculating circuit.

9. A video display apparatus having a light modulation device for forming a picture in accordance with a video signal, a lighting unit for irradiating, on said light modulation device, illumination light necessary to cause it to display the picture and a light diffusing layer for diffusing the illumination light from said lighting unit, said lighting unit being divided into n light source partitive areas which are controllable in luminance individually, said apparatus comprising:

a caption detection circuit;

a caption data conversion circuit for suitably changing a video signal corresponding to the caption detected by said caption detection circuit;

a neighboring ambient light detection circuit for detecting ambient light of the neighborhood;

a luminance distribution detection circuit for calculating a luminance distribution on the screen from video signals;

an illumination light source luminance setting circuit for setting illumination luminance levels of said individual light source partitive areas on the basis of the result of calculation by said luminance distribution detection circuit and the result of detection by said neighboring ambient light detection means;

a scene change detection circuit for detecting from a video signal a switchover of a picture scene, said illumination light source luminance setting circuit being operative to reset the illumination luminance setting values of said individual partitive areas on the basis of the result of detection by said scene change detection circuit;

an illumination light source luminance control circuit for controlling the luminance levels of said individual illumination light source partitive areas on the basis of the illumination light source luminance setting values of said individual partitive areas reset by said illumination light source luminance setting circuit;

a light diffusing layer luminance distribution calculating circuit for calculating a luminance distribution on said light diffusing layer on the basis of the illumination light source luminance setting values of said individual partitive areas reset by said illumination light source luminance setting circuit; and video signal correction means for correcting video signals on the basis of the result of luminance calculation by said light diffusing layer luminance distribution calculating circuit.

* * * * *